US007111630B2

(12) United States Patent
Mizobata et al.

(10) Patent No.: US 7,111,630 B2
(45) Date of Patent: Sep. 26, 2006

(54) HIGH PRESSURE PROCESSING APPARATUS AND METHOD

(75) Inventors: Ikuo Mizobata, Kamikyo-Ku (JP); Yusuke Muraoka, Kamikyo-Ku (JP); Kimitsugu Saito, Kamikyo-Ku (JP); Ryuji Kitakado, Kamikyo-Ku (JP); Yoichi Inoue, Takasago (JP); Yoshihiko Sakashita, Takasago (JP); Katsumi Watanabe, Takasago (JP); Masahiro Yamagata, Takasago (JP); Hisanori Oshiba, Takasago (JP)

(73) Assignees: Dainippon Screen Mfg. Co., Ltd., (JP); Kobe Steel, Ltd., (JP)

( * ) Notice: Subject to any disclaimer, the term of this patent is extended or adjusted under 35 U.S.C. 154(b) by 0 days.

(21) Appl. No.: 10/879,318

(22) Filed: Jun. 28, 2004

(65) Prior Publication Data

US 2004/0231698 A1 Nov. 25, 2004

(51) Int. Cl.
*B08B 3/04* (2006.01)

(52) U.S. Cl. ..... 134/98.1; 134/103.1; 134/186; 134/902

(58) Field of Classification Search ..... 134/95.1, 134/98.1, 100.1, 103.1, 111, 186, 902
See application file for complete search history.

(56) References Cited

U.S. PATENT DOCUMENTS

| | | | | |
|---|---|---|---|---|
| 5,355,901 | A | 10/1994 | Mielnik et al. | 134/105 |
| 5,526,834 | A | 6/1996 | Mielnik et al. | 134/105 |
| 6,092,538 | A | 7/2000 | Arai et al. | |
| 6,442,980 | B1 | 9/2002 | Preston et al. | 134/107 |
| 6,619,304 | B1 | 9/2003 | Worm | 134/140 |
| 2001/0050096 | A1 | 12/2001 | Constantini et al. | 134/58 |

FOREIGN PATENT DOCUMENTS

| | | |
|---|---|---|
| JP | 05-226311 | 9/1993 |
| JP | 08-100197 | 4/1996 |
| JP | 10-094767 | 4/1998 |
| JP | 10-163152 | 6/1998 |
| JP | 2000-308862 | 11/2000 |
| KR | 1999-63626 | 7/1999 |

*Primary Examiner*—Joseph L. Perrin
(74) *Attorney, Agent, or Firm*—Ostrolenk, Faber, Gerb & Soffen, LLP

(57) ABSTRACT

When the hatch of a substrate washing chamber 5 is opened to receive a substrate, certain valves are closed, and a valve is opened, supply $CO_2$ to purge the substrate washing chamber 5 to and exclude air. When the hatch is closed, another valve is opened to vent substrate washing chamber 5 so that the $CO_2$ expels any gas and unwanted air from the substrate washing chamber 5 and the conduits. Thereafter, super critical $CO_2$ is used to wash the substrate and clean the circulation line. The flow of supercritical $CO_2$ is sent to the substrate washing chamber 5. After flowing through the circulation line, including a circulation channel 11, it passes through a bypass channel 12 to a decompressor 7. Any chemicals or organic substances left in the circulation line are continuously sent to a separation/recover bath 8 together with the flow.

7 Claims, 11 Drawing Sheets

HIGH PRESSURE PROCESSING APPARATUS AND METHOD

BACKGROUND OF THE INVENTION

1. Field of the Invention

The present invention relates to a high pressure processing apparatus and method which employs a high pressure processing fluid. More particularly, the present invention relates to a high pressure processing apparatus and method for subjecting a substrate to a predetermined high pressure process (e.g., for removing any unwanted matter adhered on the substrate) which supplies a high pressure fluid over a substrate, such as: a semiconductor substrate; a substrate for FPDs (Flat Panel Displays) (e.g., a glass substrate for a liquid crystal display device); a glass substrate for a photomask, a substrate for an optical disk, or the like (hereinafter collectively referred to as "substrates"). Furthermore, the present invention relates to a high pressure processing apparatus and method which can be used in a drying process for removing moisture off a substrate surface, or a development process for removing unwanted portions from a substrate surface.

2. Related Art Statement

In recent years, the trend away from using flon (fluorine) for washing substrates having electronic or other components formed thereon has directed much attention to the use of a low-viscosity processing fluid which is kept in a high-pressure state (e.g., super critical $CO_2$) as a release agent or a rinse agent.

Moreover, the need for downsizing ("shrinking") semiconductor devices in recent years has led to the use of finer design rules (technology node) for devices, and this trend only appears to be growing. Such semiconductor device structures incorporate very minute trenches and holes, both of which need washing. Minute trenches may be employed for capacitors (or the capacitive portions thereof), horizontal wiring (or two-dimensional wiring), and the like. Minute holes may be employed for vertical wiring (three-dimensional wiring: connections between horizontal wires, gate electrode connections for transistors, etc.), and the like.

In such minute structures, increasingly larger ratios between the width and depth thereof (so-called "aspect ratio") have been used. In other words, there is a tendency to form narrower but deeper trenches, and to form smaller-diameter but deeper holes. Some micro-structures may have a width or a diameter on the order of submicrons, with an aspect ratio exceeding ten. After such micro-structures are formed on a semiconductor substrate through dry etching, not only the upper planar surface, but also the side walls and bottoms of the trenches and holes will be left with contamination, such as residues of the resist, denatured resist resulting from the dry etching, compounds of the resist and the bottom metal, and/or oxidized metals.

Conventionally, such contamination is washed away by using a solution-type chemical. However, since the ingression of a chemical and the later substitution with pure water may not occur smoothly in such micro-structures, unsatisfactory washing results may be obtained. Moreover, although low-dielectric constant materials (so-called "Low-k materials") are used in order to prevent delay in electrical signals due to the wiring being affected by etched insulative substances, the presence of chemicals tends to ruin the low dielectric constant. In the case where a wiring metal is exposed, it is impossible to employ a chemical which dissolves metals, which in itself is another limitation.

Super critical fluids (SCFs) are considered as a promising alternative for the washing of such micro-structures on semiconductor devices. As represented by a hatched portion in FIG. 8, an "SCF" refers to a substance which is in a state that only exists at a pressure equal to or greater than a critical pressure Pc and at a temperature equal to or greater than a critical temperature Tc. An SCF has properties intermediate between those of liquid and gas, and therefore is suitable for washing on a micro scale. Specifically, an SCF is effective for the washing of organic components due to its density (which approximates that of liquid) and high solubility, enables uniform washing due to its diffusibility which compares that of gas, and is suitable for the washing of micro components due to its low viscosity which compares that of gas.

As a substance to be converted into an SCF, carbon dioxide ($CO_2$), water ($H_2O$), nitrous oxide ($N_2O$), ammonia, ethanol, or the like may be used. Among others, $CO_2$ is frequently used because it can easily attain a super critical state due to its critical pressure Pc being 7.4 MPa and its critical temperature Tc being about 31° C. and because $CO_2$ is non-toxic.

Although $CO_2$ SCF is inert by nature, fluidic $CO_2$ has a dissolving ability similar to that of hexane, and therefore can easily remove moisture, fat, etc., off a substrate surface. Moreover, amines, ammonium fluoride, or the like—which are employed for washing contamination off semiconductor substrates—can be admixed in a suitable concentration range to obtain a multi-component SCF. Such a multi-component SCF is capable of entering into minute device structures to remove the contamination. Moreover, the admixed amines or ammonium fluoride can be easily removed from the minute device structures together with the contamination.

Unlike a solution-type chemical, an SCF does not leave its residues after permeating a low-dielectric constant insulative substance, and therefore does not alter the properties of the insulative substance. Therefore, an SCF is highly suitable for the washing of micro-structures on semiconductor devices.

FIG. 9 illustrates an exemplary apparatus which performs a wash process for a substrate using an SCF. The high pressure processing apparatus shown in FIG. 9 comprises: a cylinder 201 containing liquid $CO_2$; a condenser 202; a booster 203; a heater 204; a substrate washing chamber 205; a decompressor 207; a separation/recovery bath 208; and valves V1 and V2.

Hereinafter a wash operation of a high pressure processing apparatus having the above-described configuration will be briefly described.

First, a substrate as an object to be washed is placed within the substrate washing chamber 205, and the substrate washing chamber 205 is sealed. The following wash process begins after the placement of the substrate. First, the liquefied $CO_2$ in the cylinder 201 is supplied to the condenser 202 so as to be stored there in the liquid state. The liquefied $CO_2$ is compressed by the booster 203 to a pressure equal to or greater than the critical pressure Pc, and is further heated by the heater 204 to a temperature equal to or greater than the critical temperature Tc, thereby being converted into super critical $CO_2$, which is supplied to the substrate washing chamber 205. In the substrate washing chamber 205, a washing takes place by allowing the super critical $CO_2$ to come into contact with the substrate.

The super critical $CO_2$, containing contaminants from the substrate washing (e.g., organic substances, inorganic substances, metals, particles, and/or water which have parted from the substrate and strayed into the super critical $CO_2$ during the washing), is subjected to a final decompression by the decompressor 207 so as to be vaporized. Thereafter, the super critical $CO_2$ is separated into gaseous $CO_2$ and the contaminants in the separation/recovery bath 208. The isolated contaminants are discharged, whereas the $CO_2$ gas is recovered for recycling in the condenser 202. The substrate washing is completed by repeating the above wash process for a predetermined amount of time or longer.

However, in accordance with the above-described conventional high pressure processing apparatus, the surrounding air may stray into the chamber through the hatch opening while positioning the substrate in the substrate washing chamber 205. Therefore, when the SCF which has been used in a wash process is recovered for recycling, the surrounding air components which have strayed into the substrate washing chamber 205 may enter the SCF generation/recovery line and deteriorate the purity of the SCF used for washing.

Even if the substrate washing chamber 205 is installed in a clean room when using the above-described high pressure processing apparatus for washing a semiconductor substrate, the air within the clean room may contain various contaminants, such as $SO_x$, $NO_x$, siloxanes, boron, and vaporous organic substances.

The reduced purity of the SCF may affect the condensation temperature of the $CO_2$ gas which is recovered for recycling, whereby the performance of the substrate washing employing super critical $CO_2$ may be deteriorated.

This problem is true not only of washing techniques employing SCF, but also of any high pressure process, such as development, washing, or drying of a substrate within a closed processing chamber, that employs a subcritical fluid or a high pressure gas of ammonia, for example.

As used herein, a "subcritical fluid" generally refers to a liquid which is in a high-pressure state below the critical point shown in FIG. 8. Fluids which fall within this region are sometimes distinguishable from SCFs. However, since physical properties such as density only undergo gradual (i.e., not stepwise) changes, there may be no physical breakpoint. Therefore, a subcritical fluid might also be usable as an SCF. Any substance which lies in the subcritical region, or more broadly, in the super critical region near the critical point, may sometimes be referred to as a "high-density liquefied gas".

Thus, a high pressure processing apparatus employing such a high pressure fluid still admits of improvement in the manner of recovering for recycling the high pressure process fluid which has been used in the processing, in terms of preventing deterioration of the process performance.

An apparatus having the configuration shown in FIG. 10 may alternatively be used as an apparatus for performing a wash process for a substrate employing an SCF. The high pressure processing apparatus shown in FIG. 10 comprises: a cylinder 201 containing liquid $CO_2$, a condenser 202, a booster 203, a heater 204, a substrate processing chamber (SCF chamber) 205, a circulator 206, a decompressor 207, a separation/recovery bath 208, a switching section 209, a mixer 210, and a chemical supply section 211 which is coupled via a valve V3.

Hereinafter, a wash operation performed by the high pressure processing apparatus of the above configuration will be briefly described. A substrate as an object to be washed is placed within the substrate washing chamber 205, and the substrate washing chamber 205 is sealed. Awash process as follows is begun after the placement of the substrate. First, the liquefied $CO_2$ in the cylinder 201 is supplied to the condenser 202 so as to be stored there in the liquid state. The liquid $CO_2$ is compressed by the booster 203 to a pressure equal to or greater than the critical pressure Pc, and is further heated by the heater 204 to a temperature equal to or greater than the critical temperature Tc, thereby being converted into super critical $CO_2$, which is supplied to the mixer 210. The mixer 210 mixes a predetermined chemical which is supplied via the valve V3 with the super critical $CO_2$, and outputs the resultant mixture to the substrate washing chamber 205.

The reason for employing the aforementioned chemical will be described. Although the fluidic $CO_2$ has a dissolving ability similar to that of hexane and therefore can easily remove moisture, fat, etc., off the substrate surface, it does not provide a sufficient dissolving ability for high-molecular-weight contaminants such as resists or etching polymers. Therefore, it is difficult to release and remove contaminants by using $CO_2$ alone. This is the reason why a certain chemical (or assistant) is added to the $CO_2$ to assist in the releasing and removal of the high-molecular-weight contaminants.

In the substrate washing chamber 205, a washing takes place by allowing the super critical $CO_2$ to come into contact with the substrate. Specifically, the substrate washing is achieved by allowing the super critical $CO_2$ mixed with the chemical to circulate for a predetermined of time, based on the switching of the switching section 209 and activation of the circulator 206. The circulation-based washing for the substrate is adopted in order to minimize the amount of super critical $CO_2$ used, and to reduce the time required for washing. As a result, the running cost can be curtailed, thereby making for a more economical processing.

The super critical $CO_2$ mixed with the chemical, having dissolved or dispersed therein the containing contaminants from the substrate washing (e.g., organic substances, inorganic substances, metals, particles, and/or water which have parted from the substrate and strayed into the super critical $CO_2$ during the washing), is vaporized and subjected to a final decompression by the decompressor 207 so as to be vaporized. Thereafter, the super critical $CO_2$ is separated into gaseous $CO_2$, the chemical, and the contaminants in the separation/recovery bath 208. The isolated chemical and contaminants are discharged, whereas the $CO_2$ gas is recovered for recycling in the condenser 202. The substrate washing is completed by repeating the above wash process for a predetermined amount of time or longer.

However, in order to use the high pressure processing apparatus for long periods of time, it becomes necessary, after every wash process, to clean the entire system of the chemical and residues in the channels of the circulation line and other components. Moreover, in the case of performing wash processes using different chemicals with the same apparatus, it is also necessary to perform a cleaning process to remove the residues of the chemical used in the previous process, before a new chemical can be used. This cleaning process is usually performed by allowing an SCF to flow through the entire system without mixing any chemicals therein. Therefore, in order to clean the circulation channel 212 which is part of the circulation line, only an SCF is circulated, and after the lapse of a predetermined period of time, the SCF in the circulation line is discharged to the decompressor 207. This operation must be repeated as necessary.

Cleaning the entire system through the above-described operation will invite a prolonged cleaning process time, a lower throughput of the high pressure processing apparatus, and a larger amount of SCF being used in the cleaning process, thus leading to increased cost.

Furthermore, unlike the processing operation performed by the high pressure processing apparatus, the above-described cleaning process is a separately and non-routinely performed process, and therefore does not make for much improved cleanliness within the circulation line. Consequently, the cleanliness with respect to the object to be processed is also deteriorated. Moreover, when wash processes are performed with different chemicals, a chemical which was used before the cleaning process may inevitably be mixed with a new chemical used in the circulation line, thereby resulting in unwanted chemical reactions between the chemicals, or making it impossible to perform a desired wash process. Thus, there are limits to the chemicals which can be used in the conventional high pressure processing apparatus.

Another known method is illustrated in FIG. 11, under which a cleaning process is performed in a conventional high pressure processing apparatus by supplying an SCF containing no chemicals (referred to as "fresh SCF") to the circulation line from a separate line. In the high pressure processing apparatus shown in FIG. 11, a "fresh" super critical $CO_2$ is supplied from a fresh SCF supply section 213. Therefore, the cleanliness within the substrate washing chamber 205 is improved. However, as is the case with the aforementioned cleaning operation, the cleaning of the interior of the circulation line in this case occurs as a restricted process which requires the entire system to only execute a cleaning operation. Thus, this method does not solve the aforementioned problems.

Likewise, the above problems are true not only of washing techniques employing SCF, but also of any high pressure process, such as development, washing, or drying of a substrate within a closed processing chamber, that employs a subcritical fluid or a high pressure gas of ammonia, for example.

SUMMARY OF THE INVENTION

The present invention has been made in order to solve the aforementioned problems, and an object thereof is to provide a high pressure processing apparatus and method which is capable of performing a substrate processing by employing a pure high pressure fluid, without allowing any surrounding air components which may have strayed into the processing chamber during the substrate placement to enter a high pressure fluid generation/recovery line. A further object of the present invention is to provide a high pressure processing apparatus and method which employs a high pressure fluid capable of efficiently cleaning the lines in the high pressure processing apparatus, while providing an improved cleanliness in the lines.

The present invention has the following features to attain the object above.

A first aspect of the present invention is directed to a high pressure processing apparatus for subjecting a substrate to a predetermined process by employing a high pressure fluid, comprising: a high pressure fluid supply section for converting a predetermined processing fluid into a high pressure fluid and supplying the high pressure fluid; a substrate processing section for processing a substrate placed in a processing chamber by allowing the high pressure fluid supplied from the high pressure fluid supply section to be in contact with the substrate; a high pressure fluid recovery section for recovering for recycling the high pressure fluid after the high pressure fluid is used for processing the substrate in the substrate processing section; an atmosphere replacement fluid supply section for supplying an atmosphere replacement fluid into the processing chamber, the atmosphere replacement fluid being of a same composition as that of the high pressure fluid; and a discharge section for discharging a gas residing within the processing chamber, wherein, the atmosphere replacement fluid supply section supplies the atmosphere replacement fluid into the processing chamber and the discharge section discharges the gas residing within the processing chamber being expelled with the supply of the atmosphere replacement fluid, during a period after the processing chamber is closed following the placement of the substrate in the processing chamber and until the high pressure fluid begins to be supplied.

Thus, by forming a vent line for a processing chamber in which a substrate is placed, and supplying an atmosphere replacement fluid having the same composition as that of the high pressure fluid used for the processing into the processing chamber, any surrounding air components which may have strayed in during the placement of the substrate can be expelled by this fluid. As a result, the surrounding air components which may have strayed into the processing chamber are prevented from entering the high pressure fluid recovery section.

The atmosphere replacement fluid supply section may supply as the atmosphere replacement fluid the processing fluid before being converted into the high pressure fluid. Thus, an atmosphere replacement fluid having the same composition can be easily obtained.

The atmosphere replacement fluid supply section may supply the atmosphere replacement fluid into the processing chamber until the processing chamber is closed following the placement of the substrate in the processing chamber. Thus, since a fluid having the same composition as that of the high pressure fluid used for the processing is supplied to the processing chamber while the hatch of the processing, chamber is open, the surrounding air components are primarily prevented from straying into the washing chamber in a state open to the surrounding air.

The substrate processing section may process the substrate by circulating the high pressure fluid. In this case, the high pressure fluid employed for the substrate processing can be utilized efficiently.

The high pressure fluid supplied from the high pressure fluid supply section may be a super critical fluid. Thus, even in the case of a high pressure process employing an SCF having a high processing ability, the surrounding air components which may have strayed into the processing chamber are prevented from entering the high pressure fluid recovery section, and the surrounding air components are prevented from straying into the washing chamber in a state open to the surrounding air.

A second aspect of the present invention is directed to a high pressure processing method for subjecting a substrate to a predetermined process by employing a high pressure fluid, comprising, a step of supplying an atmosphere replacement fluid into a processing chamber after the processing chamber is closed following the placement of a substrate in the processing chamber for processing, the atmosphere replacement fluid being of a same composition as that of the high pressure fluid; a step of discharging a gas residing within the processing chamber being expelled with the supply of the atmosphere replacement fluid; a step of converting a predetermined processing fluid into a high pressure fluid and supplying the high pressure fluid; a step of processing the substrate placed in the processing chamber by employing the supplied high pressure fluid; and a step of recovering for recycling the high pressure fluid after the high pressure fluid is used for processing the substrate.

Thus, by forming a vent line for a processing chamber in which a substrate is placed, and supplying an atmosphere replacement fluid having the same composition as that of the high pressure fluid used for the processing into the processing chamber, any surrounding air components which may have strayed in during the placement of the substrate can be expelled by this fluid. As a result, the surrounding air components which may have strayed into the processing chamber are prevented from entering the high pressure fluid recovery section.

The atmosphere replacement fluid may be the processing fluid before being converted into the high pressure fluid.

The high pressure processing method may further comprise a step of supplying the atmosphere replacement fluid into the processing chamber until the processing chamber is closed following the placement of the substrate in the processing chamber.

The step of processing the substrate may be performed by circulating the high pressure fluid.

The high pressure fluid supplied in the step of supplying the high pressure fluid may be a super critical fluid.

A third aspect of the present invention is directed to a high pressure processing apparatus for processing an object to be processed by employing a high pressure fluid, comprising: a circulation line for circulating a high pressure fluid in one direction; a processing section provided in the circulation line for processing an object to be processed by employing the high pressure fluid circulated through the circulation line, and returning the high pressure fluid to the circulation line after the processing; a supply/discharge switching section provided in the circulation line for switching channels to redirect the high pressure fluid through at least one selected from: a channel for supplying the high pressure fluid to the circulation line, and a channel for discharging the high pressure fluid from the circulation line; a supply line for supplying the high pressure fluid to the circulation line via the supply/discharge switching section; a discharge line for discharging the high pressure fluid from the circulation line; and a bypass channel for redirecting the high pressure fluid circulated through the circulation line from the supply/discharge switching section so as to be supplied to the discharge line, wherein, when processing the object to be processed, the high pressure fluid supplied from the supply line is circulated through the circulation line, and wherein, when cleaning the circulation line, the supply/discharge switching section switches channels so that the high pressure fluid supplied from the supply line flows into the discharge line via the bypass channel after the high pressure fluid has made one complete round through the circulation line without redundancy.

Thus, it is possible to easily switch between the supply line for the high pressure fluid, the circulation line, and the line for cleaning the circulation line, through the switching of the supply/discharge switching section. In the line for cleaning the circulation line, chemicals and/or any other matter left in the circulation line can be continuously discharged as effluent through the use of a single line; therefore, it is unnecessary to separately repeat a circulation step and a discharging step. As a result, the time required for the cleaning process is reduced, thereby improving the throughput of the high pressure processing apparatus. Moreover, the cost can be curtailed because the amount of SCF used for the cleaning can be reduced. Since the circulation line is cleaned in continuous cycles, as opposed to a sporadic manner, the cleanliness within the lines can be easily improved. Furthermore, the above effect can be realized by providing a single supply line for supplying a high pressure fluid.

The circulation line may further comprise a chemical mixing section provided on a primary side of the processing section, the chemical mixing section being operative to supply from a chemical supply section a chemical other than the high pressure fluid to the circulation line. Thus, an apparatus having an even higher processing performance can be provided through the use of a chemical which is in accordance with the contaminants. Furthermore, the circulation line after the cleaning process is rendered free of any chemicals which were used prior to the cleaning process. Therefore, in the case where a different chemical is to be used after the cleaning process, the unwanted mixing of the previous chemical or unwanted chemical reactions between the previous and new chemicals can be prevented. Thus, the present high pressure processing apparatus permits the use of various kinds of chemicals, without any chemical-dependent limitations on its applications.

The circulation line may further comprise a heating section for heating the high pressure fluid circulated through the circulation line. Thus, the circulation line can be stabilized at an appropriate temperature. As a result, when performing the process based on the circulation line, a stable high pressure fluid can be supplied to the processing section.

The high pressure processing apparatus may further comprise a control section for controlling the switching of channels for the high pressure fluid circulated through the circulation line, wherein the supply/discharge switching section is controlled by the control section to switch channels to redirect the high pressure fluid through at least one selected from: a channel for supplying the high pressure fluid to the circulation line, and a channel for discharging the high pressure fluid from the circulation line. Thus, processing lines can be switched automatically by the control section.

The above high pressure fluid may be a super critical fluid. Thus, even in the case of a high pressure process employing an SCF having a high processing ability, it is possible to easily switch between the supply line for the SCF, the circulation line, and the line for cleaning the circulation line, through the switching of the supply/discharge switching section. In the line for cleaning the circulation line, chemicals and/or any other matter left in the circulation line can be continuously discharged as effluent through the use of a single line; therefore, it is unnecessary to separately repeat a circulation step and a discharging step. As a result, the time required for the cleaning process is reduced, thereby improving the throughput of the high pressure processing apparatus. Moreover, the cost can be curtailed because the amount of SCF used for the cleaning can be reduced. Since the circulation line is cleaned in continuous cycles, as opposed to a sporadic manner, the cleanliness within the lines can be easily improved. Furthermore, the above effect can be realized by providing a single supply line for supplying a high pressure fluid.

A fourth aspect of the present invention is directed to a high pressure processing apparatus for processing an object to be processed by employing a high pressure fluid, comprising: a circulation line for circulating a high pressure fluid in one direction; a processing section provided in the circulation line for processing an object to be processed by employing the high pressure fluid circulated through the circulation line, and returning the high pressure fluid to the circulation line after the processing; a supply/discharge switching section provided in the circulation line for switching channels to redirect the high pressure fluid through at least one selected from: a channel for supplying the high pressure fluid to the circulation line, and a channel for discharging the high pressure fluid from the circulation line; a first supply line for supplying the high pressure fluid to the circulation line; a second supply line for supplying the high pressure fluid to the circulation line via the supply/discharge switching section; a discharge line for discharging the high pressure fluid from the circulation line; and a bypass channel for redirecting the high pressure fluid circulated through the circulation line from the supply/discharge switching section so as to be supplied to the discharge line, wherein, when processing the object to be processed, the high pressure fluid supplied from the first supply line is circulated through the circulation line, and wherein, when cleaning the circulation line, the supply/discharge switching section switches channels so that the high pressure fluid supplied from the second supply line flows into the discharge line via the bypass channel after the high pressure fluid has made one complete round through the circulation line without redundancy.

Thus, it is possible to easily switch between the supply line for the high pressure fluid, the circulation line, and the line for cleaning the circulation line, through the switching of the supply/discharge switching section. In the line for cleaning the circulation line, chemicals and/or any other matter left in the circulation line can be continuously discharged as effluent through the use of a single line; therefore, it is unnecessary to separately repeat a circulation step and a discharging step. As a result, the time required for the cleaning process is reduced, thereby improving the throughput of the high pressure processing apparatus. Moreover, the cost can be curtailed because the amount of SCF used for the cleaning can be reduced. Since the circulation line is cleaned in continuous cycles, as opposed to a sporadic manner, the cleanliness within the lines can be easily improved.

The supply/discharge switching section may be provided at a position on the circulation line adjacent to a primary side of the processing section. Thus, it is possible to supply a fresh high pressure fluid directly to the processing section, where chemical substances generated through the processing of the object to be processed are highly likely to be accumulated for structural reasons. Therefore, processing results with a higher cleanliness can be obtained by a processing step after the cleaning.

The circulation line may further comprise a chemical mixing section provided on a primary side of the supply/discharge switching section, the chemical mixing section being operative to supply from a chemical supply section a chemical other than the high pressure fluid to the circulation line.

The circulation line may further comprise a heating section for heating the high pressure fluid circulated through the circulation line.

The high pressure processing apparatus may further comprise a control section for controlling the switching of channels for the high pressure fluid circulated through the circulation line, wherein the supply/discharge switching section is controlled by the control section to switch channels to redirect the high pressure fluid through at least one selected from: a channel for supplying the high pressure fluid to the circulation line, and a channel for discharging the high pressure fluid from the circulation line.

The above high pressure fluid may be a super critical fluid.

These and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Hereinafter, a high pressure processing apparatus according to a first embodiment of the present invention will be described with reference to the accompanying figures.

A typical example of a process to be performed by the present high pressure processing apparatus is a wash process for releasing and removing contaminants from an object to be processed, as in the case of removing a resist adhered on a semiconductor substrate. The substrate as an object to be processed is not limited to a semiconductor substrate. The present invention is applicable to any substrates composed of a base material (e.g., metals, plastics, ceramics), with non-continuous or continuous layers of heterogeneous substances being left on whose surface.

Figure 1:
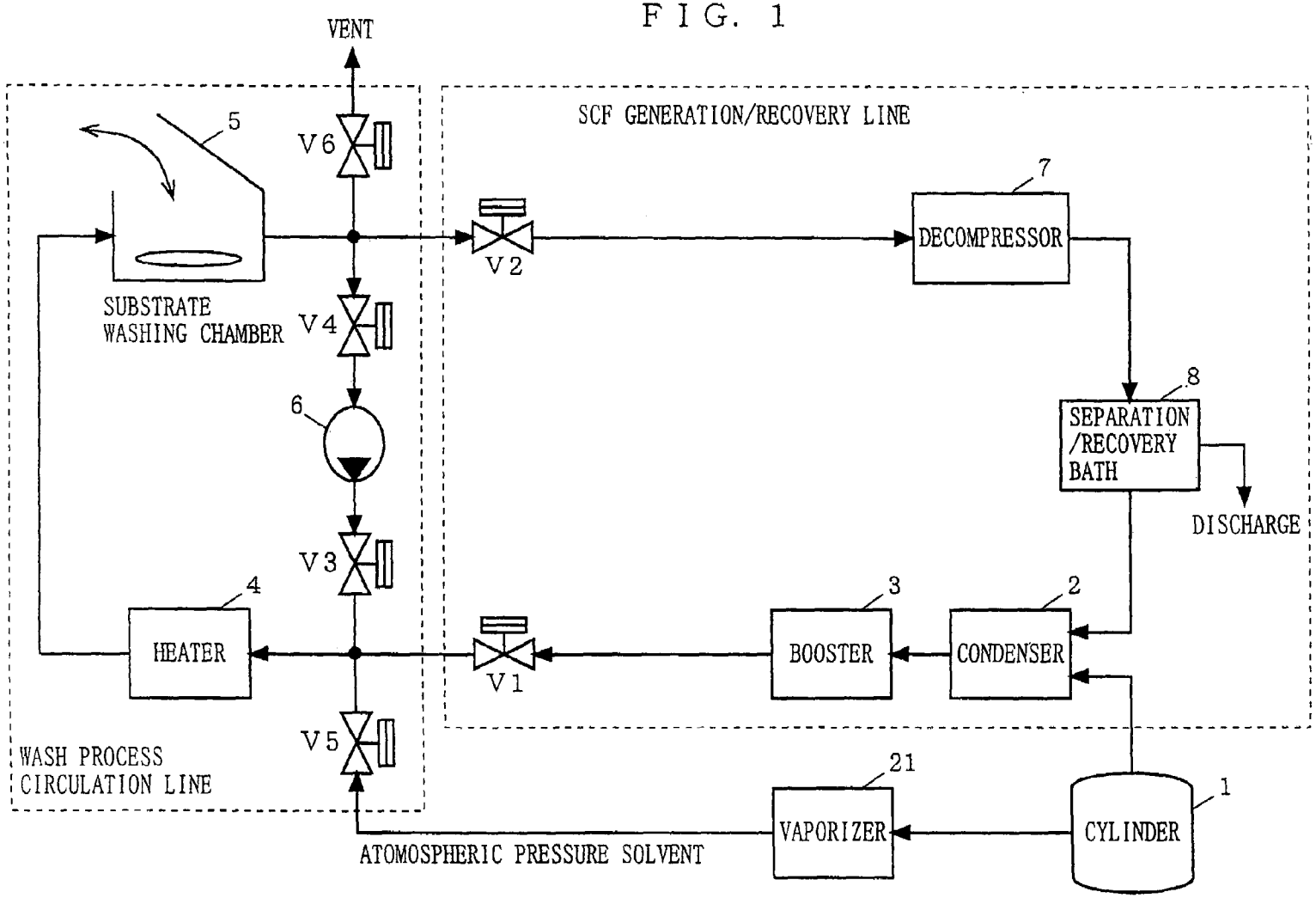
FIG. 1 is a block diagram illustrating the structure of a high pressure processing apparatus according to a first embodiment of the present invention.

FIG. 1 is a block diagram illustrating the structure of a high pressure processing apparatus according to a first embodiment of the present invention. As shown in FIG. 1, the present high pressure processing apparatus comprises a cylinder 1, a condenser 2, a booster 3, a heater 4, a substrate washing chamber 5, a decompressor 7, a separation/recovery bath 8, valves V1 to V6, a circulation pump 6, and a vaporizer 21.

First, the components of the present high pressure processing apparatus will be described.

Figure 8:
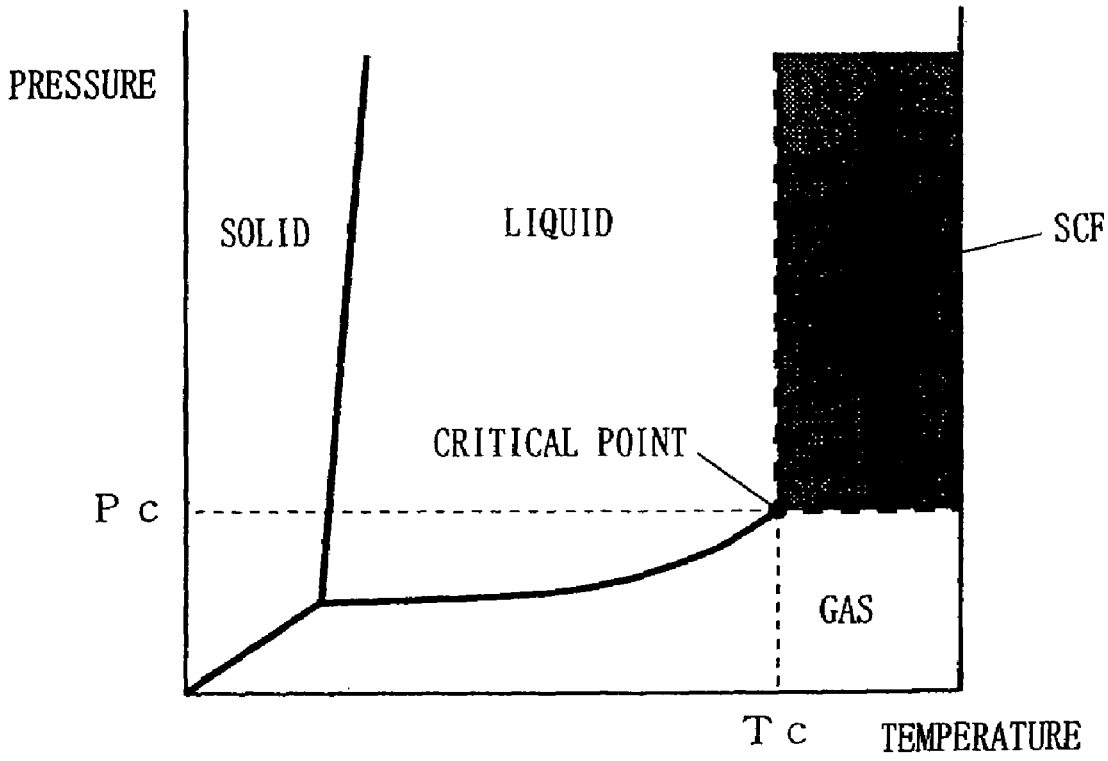
FIG. 8 is a graph for explaining SCF.
Figure 9:
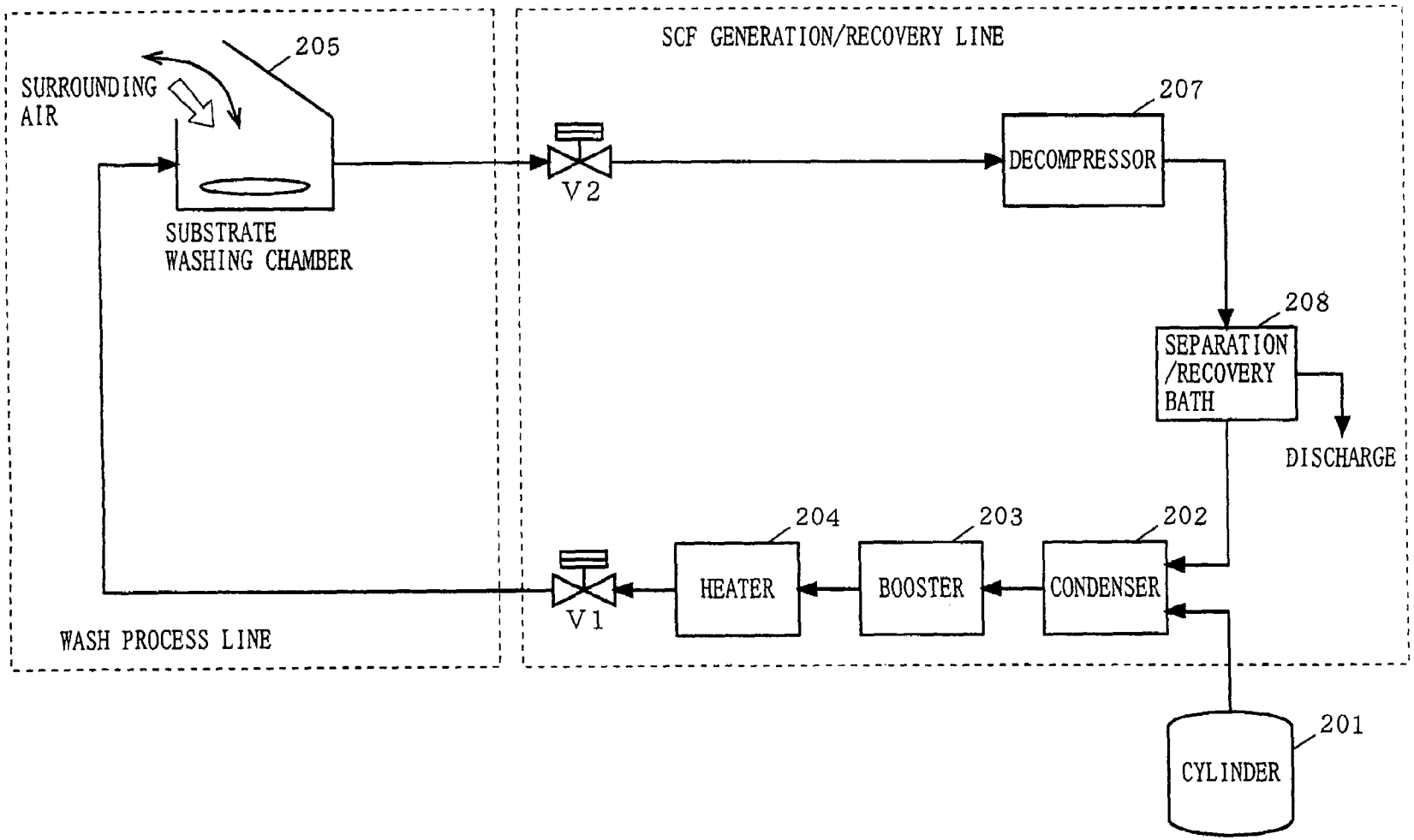
FIG. 9 PRIOR ART
FIG. 9 is a block diagram illustrating an exemplary conventional high pressure processing apparatus performs substrate washing by using an SCF.
Figure 10:
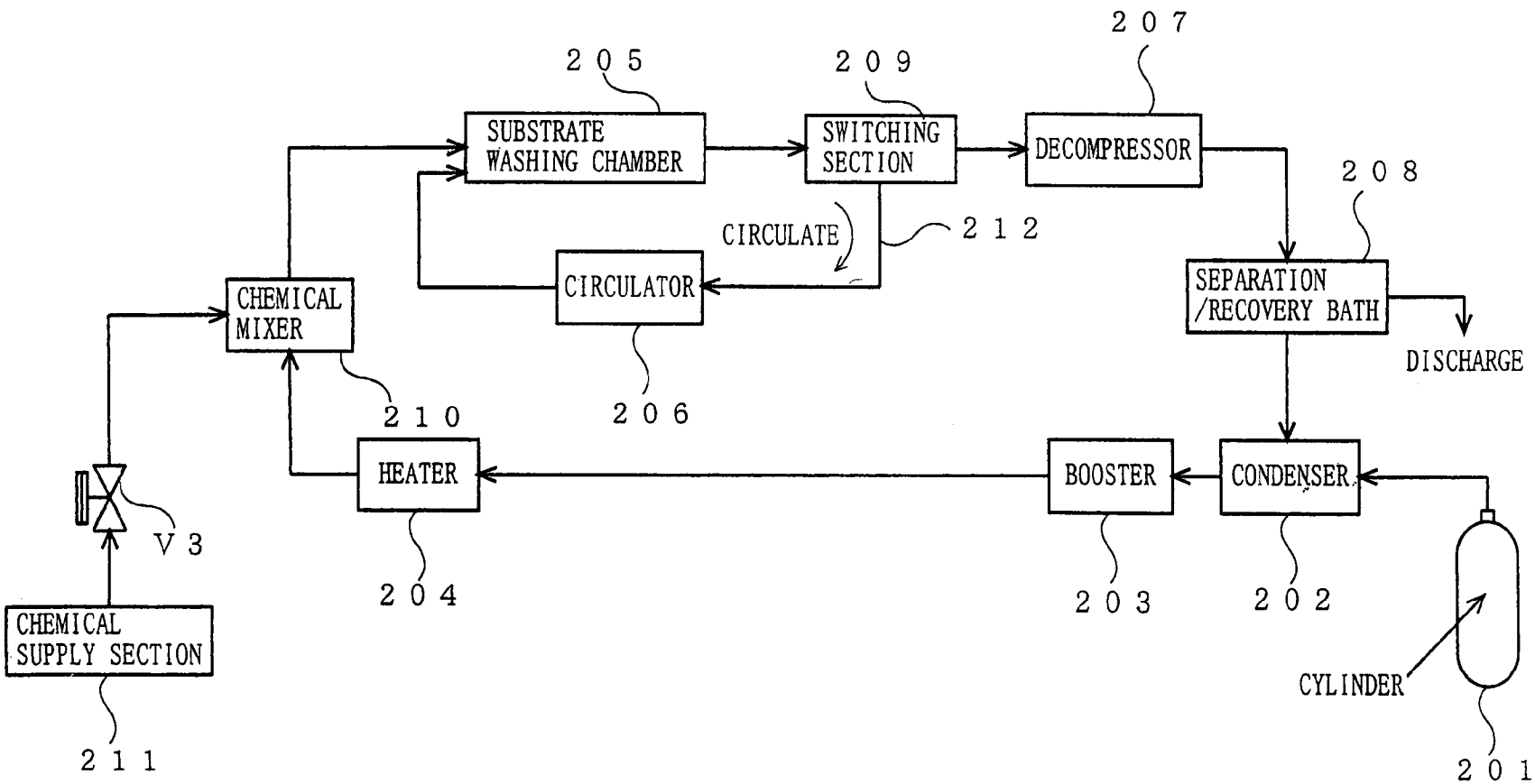
FIG. 10 PRIOR ART
FIG. 10 is a block diagram illustrating the structure of a conventional high pressure processing apparatus which incorporates a circulation line.
Figure 11:
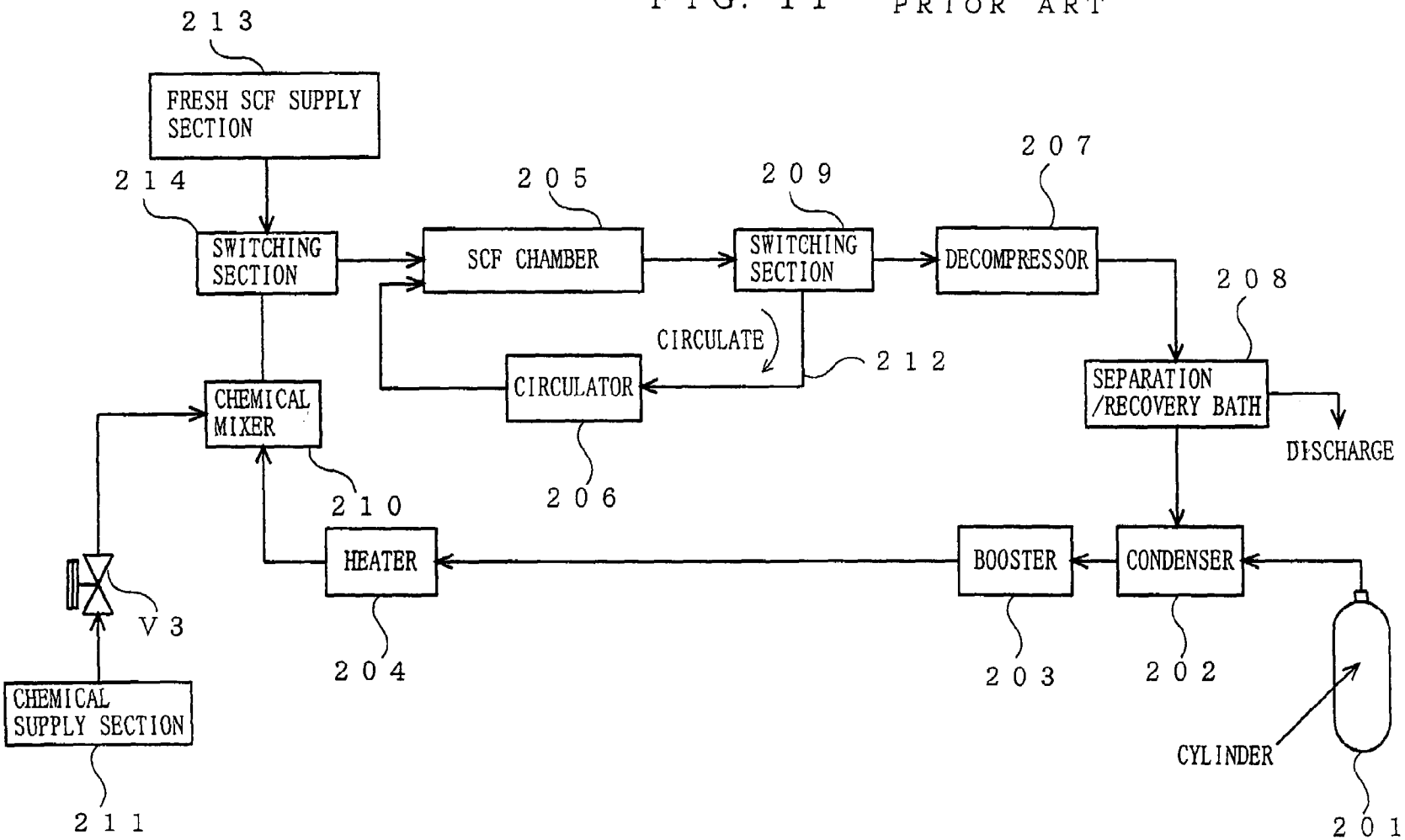
FIG. 11 PRIOR ART
FIG. 11 is a block diagram illustrating a conventional high pressure processing apparatus which incorporates a fresh SCF supply section.

The cylinder 1 contains liquefied $CO_2$ to be used for washing a substrate. The condenser 2 cools down and liquefies the gaseous $CO_2$ supplied from the separation/ recovery bath 8. The booster 3 compresses the $CO_2$ which has been liquefied by the condenser 2 to a predetermined pressure which is equal to or greater than a critical pressure Pc. The heater 4 heats the liquefied $CO_2$ which has been compressed by the booster 3 to a predetermined temperature which is equal to or greater than a critical temperature Tc. Thus, the liquefied $CO_2$ is converted into an SCF (Super Critical Fluid: SCF) (see FIG. 8). The super critical $CO_2$ is exemplary of a high pressure processing fluid which can be used in the present invention.

In the substrate washing chamber 5 as a processing chamber, a substrate is washed by using the super critical $CO_2$ generated in the above-described manner. Through decompression, the decompressor 7 vaporizes the super critical $CO_2$ which has been subjected to a wash process in the substrate washing chamber 5. In the separation/recovery bath 8, the $CO_2$ gas obtained through vaporization in the decompressor 7 is separated from the contaminants, and the $CO_2$ gas is again supplied to the condenser 2.

The valves V1 and V2 are valves used for separating an SCF generation/recovery line from a wash process circulation line. The valve V1 is disposed on a conduit interconnecting a secondary side of the heater 4 and a primary side of the booster 3. The valve V2 is disposed on a conduit interconnecting a secondary side of the substrate washing chamber 5 and a primary side of the decompressor 7.

The valves V3 and V4 are valves used for establishing the wash process circulation line. The valve V3 is disposed on a conduit interconnecting an outlet of the circulation pump 6 and a primary side of the heater 4. The valve V4 is disposed on a conduit interconnecting the secondary side of the substrate washing chamber 5 and an inlet of the circulation pump 6.

The valves V5 and V6 are valves used for "purging", i.e., replacing the atmosphere in, the interior of the substrate washing chamber 5. The valve V5 is disposed on a conduit interconnecting the cylinder 1 and a primary side of the substrate washing chamber 5 via the vaporizer 21. The valve V6 is disposed on a conduit for opening the secondary side of the substrate washing chamber 5 into the surrounding air.

The present specification employs the following terminology as necessary. The conduit line from the cylinder 1 to the substrate washing chamber 5 (via the valve V1) constitutes a "high pressure fluid supply section". The conduit line from the cylinder 1 to the substrate washing chamber 5(via the valve V5) constitutes an "atmosphere replacement fluid supply section". The conduit line from the substrate washing chamber 5 and opening into the surrounding air (via the valve V6) constitutes a "discharge section". The substrate washing chamber 5 constitutes a "substrate processing section". The conduit line from the substrate washing chamber 5 to the condenser 2 (via the valve V2) constitutes a "recovery section".

Figure 2:
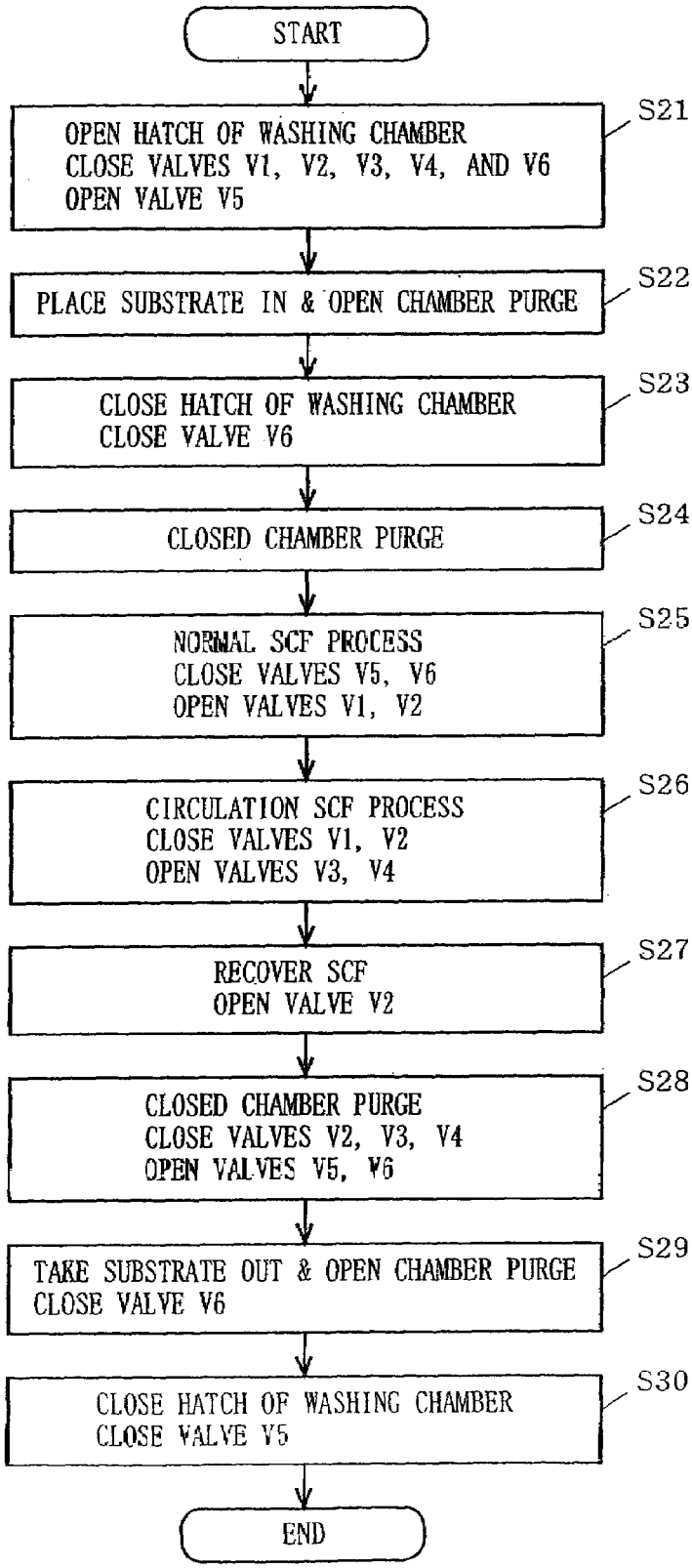
FIG. 2 is a flowchart illustrating a flow of steps of a high pressure processing method according to the first embodiment of the present invention.

Next, with reference to FIG. 2, a high pressure process which is performed by the high pressure processing apparatus according to the first embodiment, i.e., a substrate wash operation, will be described.

While the present embodiment illustrates the case where $CO_2$ is employed as a processing fluid, any other substance which is capable of being converted into an SCF, e.g., nitrous oxide, alcohol, ethanol, or water, may be employed instead. The substrate washing technique to be used in the substrate washing chamber according to the present embodiment may be batch processing (i.e., a plurality of substrates are washed simultaneously) or single substrate processing.

First, as an object to be washed, a substrate is placed within the substrate washing chamber 5. When the substrate is placed, only the valve V5 is opened, while the valves V1, V2, V3, V4, and V6 are closed (step S21).

Initially, $CO_2$ to be used as the processing fluid is stored in the cylinder 1 in the form of a liquid fluid, at a pressure in the range from 5 to 6 MPa. The liquefied $CO_2$ is taken out of the cylinder 1 by means of a pump (not shown), so as to be sent to the vaporizer 21 for vaporization. The open valve V5 allows the vaporized $CO_2$ gas to be supplied to the substrate washing chamber 5 as an atmosphere replacement fluid (step S22).

Thus, according to the present invention, a processing fluid having the same composition as that of the super critical $CO_2$ used for the washing is first supplied, with the hatch of the substrate washing chamber 5 open. Specifically, by supplying as an atmosphere replacement fluid a $CO_2$ gas which has not undergone compression or heating, the surrounding air components (i.e., components from the surrounding air) are prevented from straying into the substrate washing chamber 5 ("open chamber purge").

Next, once the substrate is placed and the hatch of the substrate washing chamber 5 is closed, the valve V6 is additionally opened (step S23). The valve V6, now opened, allows a path (vent line) to be formed which extends from the cylinder 1 to the substrate washing chamber 5 and opens to the surrounding air. As a result, $CO_2$ gas can be continuously supplied (step S24).

Thus, according to the present invention, $CO_2$ gas is continuously supplied, with the hatch of the substrate washing chamber 5 being closed. As a result, the gas residing within the substrate washing chamber 5 and the conduits is expelled to the surrounding air (i.e., the gas residing within the substrate washing chamber 5 and the conduits is replaced with the $CO_2$ gas). Thus, the atmosphere replacement ensures substantially complete elimination of any surrounding air components which may possibly have strayed in ("closed chamber purge").

Once the strayed surrounding air components (if any) are expelled so that the interior of the substrate washing chamber 5 and the conduits is filled exclusively with $CO_2$ gas, the valves V5 and V6 are closed and the valves V1 and V2 are opened. Thus, an SCF generation/recovery line is established (step S25). Once the SCF generation/recovery line is established, liquefied $CO_2$ is supplied from the cylinder 1 to the condenser 2.

The liquefied $CO_2$ which is stored in the condenser 2 in a liquid form is compressed in the booster 3 to a pressure which is equal to or greater than the critical pressure Pc, and heated by the heater 4 to a predetermined temperature which is equal to or greater than the critical temperature Tc, thereby being converted into an SCF. The SCF is sent to the substrate washing chamber 5 upon generation (thus completing step S25).

The predetermined pressure and temperature may be arbitrarily selected based on the type of the substrate to be washed and the desired washing performance. In the substrate washing chamber 5, the substrate is washed with the super critical $CO_2$ which is in a high-pressure state.

Once the portion of wash process circulation line which extends from the secondary side of the heater 4 to the primary side of the decompressor 7 is filled with the super critical $CO_2$, the valves V1 and V2 ate closed, the valves V3 and V4 are opened, and the circulation pump 6 is activated. Thereafter, the substrate is washed by circulating the super critical $CO_2$ in the wash process circulation line for a predetermined period of time (step S26).

The circulation-based washing for the substrate is adopted in order to minimize the amount of super critical $CO_2$ used, and to enhance the utilization efficiency. As a result, the running cost can be curtailed, thereby making for a more economical processing. Even in the case where an assistant(s) (i.e., a chemical(s) for facilitating the release of the resist, such as amines ammonium fluoride) is mixed to the super critical $CO_2$ within a conduit lying immediately previous to the substrate washing chamber 5, as may be performed depending on the specific substrate to be washed, the present invention ensures that the chamber purges are performed with a pure $CO_2$ gas which is free of any such assistants.

After the substrate washing is completed, the valve V2 is opened in order to recover the super critical $CO_2$ for recycling (step S27). The super critical $CO_2$ in a high-pressure state, containing contaminants from the substrate washing, is decompressed by the decompressor 7 for vaporization. Thereafter, the super critical $CO_2$ is separated into gaseous $CO_2$ and the contaminants in the separation/recovery bath 8. The isolated contaminants are discharged, whereas the $CO_2$ gas is recovered for recycling in the condenser 2. For example, the decompressor 7 may maintain the super critical $CO_2$ at about 80° C. or above and decompress it to a pressure in the range between 15 MPa and 6 MPa to obtain gaseous $CO_2$.

Once the recovery of the super critical $CO_2$ is completed, the valves V2, V3, and V4 are closed and the valves V5 and V6 are opened; and $CO_2$ gas is again supplied into the substrate washing chamber 5 ("closed chamber purge")(step S28). The valve V6 is closed before retrieval of the substrate which is placed within the substrate washing chamber 5 in order to prevent the surrounding air components from straying into the substrate washing chamber 5 ("open chamber purg")(step S29).

Thereafter, once the hatch is closed after retrieval of the substrate from the substrate washing chamber 5, the valve V5 is closed, thereby ending the process (step S30). In the case where another substrate is to be washed consecutively, the process may return to step S23 after the completion of step S29 to repeat the above-described process.

As described above, in the high pressure processing apparatus and method according to one embodiment of the present invention, a fluid having the same composition as that of the SCF used for the washing is supplied to the substrate washing chamber 5 during the placement of a substrate. As a result, the surrounding air components are prevented from straying into the substrate washing chamber 5 in a state open to the surrounding air ("open chamber purge"). Furthermore, a vent line which extends to the closed substrate washing chamber 5 is established in order to supply a fluid to the substrate washing chamber 5, so that any surrounding air components which may have strayed in can be expelled by the atmosphere replacement fluid ("closed chamber purge"). Thus, any surrounding air components which may have strayed into the substrate washing chamber 5 during the substrate placement are prevented from entering the SCF generation/recovery line, thereby enabling a substrate washing to occur with an SCF of an uncompromised purity.

The present invention is not limited to the above-described first embodiment, but also admits of other variants, as is described below.

(1) In the above-described embodiment, a process for preventing the straying of surrounding air components into the substrate washing chamber 5 ("open chamber purge") is first performed by supplying $CO_2$ gas with the hatch of the substrate washing chamber 5 being open (step S21, S22). However, this process may be omitted. In that case, only a process for ensuring the elimination of any strayed surrounding air components by extruding the gas residing within the substrate washing chamber 5 and the conduits to the surrounding air may be performed by supplying $CO_2$ gas with the hatch of the substrate washing chamber 5 being closed ("closed chamber purge"). The aforementioned effects can be attained in this manner as well.

(2) In the above-described embodiment, a chamber purge is performed in order to expel the gas residing within the substrate washing chamber 5 and the conduits to the surrounding air. Alternatively, the gas residing within the conduits may be expelled to the surrounding air via the wash process circulation line composed of the valves V3 and V4 and the circulation pump 6 and via the valve V6.

(3) The above-described embodiment illustrates a case where the valve V6 is provided as a valve dedicated to the function of expelling the gas residing within the substrate washing chamber 5 and the conduits to the surrounding air. Alternatively, the discharge path via the valve V6 do not need to be separately provided if another path exists for discharging the gas (e.g., a discharge path from the separation/recovery bath 8).

(4) In the above-described embodiment, a substrate washing is performed by employing the wash process circulation line composed of the valves V3 and V4 and the circulation pump 6 to circulate super critical $CO_2$ only for a predetermined period of time, in order to optimize the utilization efficiency of the super critical $CO_2$. Alternatively, a substrate washing may be performed by using the SCF generation/recovery line alone, without establishing a wash process circulation line.

(5) Furthermore, the positions of the valves V1 to V6 are not limited to those illustrated in the above-described embodiment, but may be any other positions which allow the aforementioned vent line to be formed.

(6) In the above-described embodiment, the decompressor 7 provided downstream the substrate washing chamber 5 vaporizes the SCF before it is outputted to the separation/recovery bath 8. Alternatively, the SCF may be first decompressed by the separation/recovery bath 8, and thereafter separated into a gaseous component and a liquid component.

(7) Although the illustrated high pressure processing apparatus is designed to perform a substrate washing, the present invention is not limited thereto. Any drying or development process which employs a high pressure fluid and a chemical(s) other than the high pressure fluid to remove unwanted substances from a substrate can be used as the high pressure process according to the present invention. Specifically, a substrate which has undergone a rinse washing (washing with water) is placed in the substrate washing chamber 5. In the substrate washing chamber 5, the moisture adhered on the substrate can be dissolved into a high pressure processing fluid which is in a super critical or subcritical state. Thereafter, the processing fluid may be recovered for recycling, as in the above-described embodiment.

A development process for a substrate can be performed by placing a silicon wafer having a resist pattern formed thereon in the substrate washing chamber 5, and developing the resist pattern on the substrate in the substrate washing chamber 5 by using a high pressure processing fluid which is in a super critical or subcritical state.

(8) The processing operation for a substrate is not limited to a single instance of a development process, a wash process, or a drying process. Rather, a number of such processes may be consecutively performed, e.g., a substrate which has undergone a development process may subsequently be subjected to a drying process. A substrate which has undergone a drying process may subsequently be subjected to a wash process.

(9) In the above-described embodiment, the processing fluid is supplied to the substrate washing chamber 5 as an SCF. Specifically, the fluid supplied to the substrate washing chamber 5 is in a predetermined high-pressure state defined by a pressure equal to or greater than 1 MPa. Preferably, the fluid has a high density, a high solubility, a low viscosity, and a high diffusibility. The reason for employing a high pressure fluid is that its high diffusion coefficient allows dissolved contaminants to be diffused throughout the high pressure fluid. An SCF, which is in an even higher-pressure state, can better permeate minute patterns due to its properties which are intermediate between those of liquid and gas. Again, a high pressure fluid has a density close to that of a liquid, so that it can contain a far greater amount of additives (chemicals) than a gas can.

More preferable are fluids which are in a super critical state or a subcritical state. In a washing step, or in a rinsing or drying/development-step, etc., following a washing step, it is preferable to employ a subcritical (high pressure fluid) or an SCF in the range of 5 to 30 MPa, and more preferably 7.1 to 20 MPa.

Second Embodiment

Hereinafter, a high pressure processing apparatus according to a second embodiment of the present invention will be specifically described, with reference to the accompanying figures. For conciseness, any descriptions related to an open chamber purge and a closed chamber purge are omitted in the present embodiment, although an open chamber purge and a closed chamber purge (as described in the first embodiment) can be readily performed by providing a vaporizer and a vent line in the high pressure processing apparatus according to the second embodiment.

Figure 3:
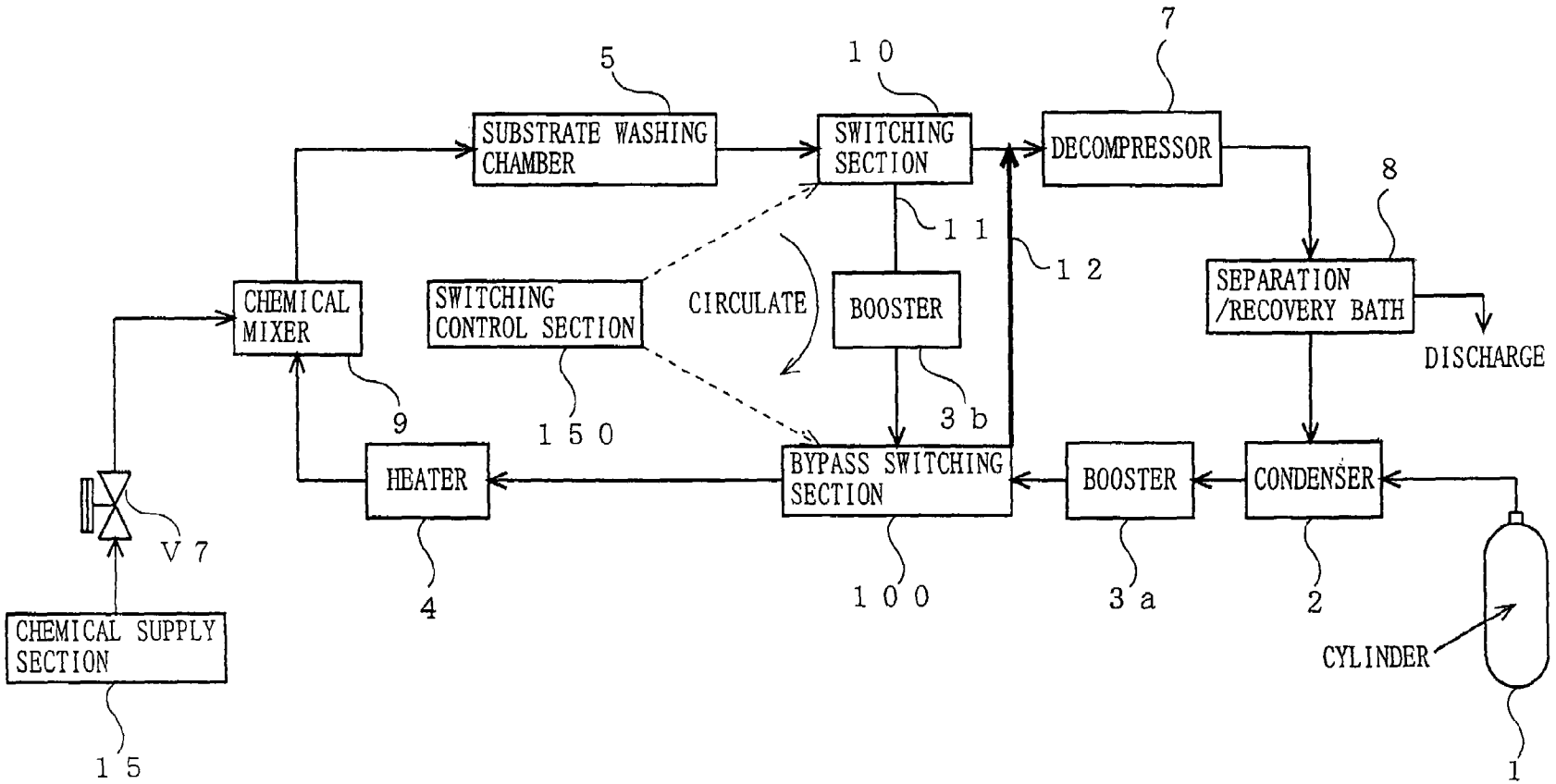
FIG. 3 is a block diagram illustrating the structure of a high pressure processing apparatus according to a second embodiment of the present invention.

FIG. 3 is a block diagram illustrating the structure of the high pressure processing apparatus according to the second embodiment of the present invention. As shown in FIG. 3, the high pressure processing apparatus comprises a cylinder 1, a condenser 2, boosters 3*a* and 3*b*, a heater 4, a substrate washing chamber 5, a chemical supply section 6, a decompressor 7, a separation/recovery bath 8, a chemical mixer 9, a switching section 10, a bypass switching section 100, and a valve V7. The connections between these components are realized by pressure-resistant conduits. A circulation channel 11 interconnects the switching section 10 and the bypass switching section 100 via a booster 3*b*. A bypass channel 12 interconnects the bypass switching section 100 and a secondary side of the switching section 10. The high pressure processing apparatus further comprises a switching control section 150 for controlling the opening and closing of the respective valves (described below) in the switching section 10 and the bypass switching section 100.

Figure 4:
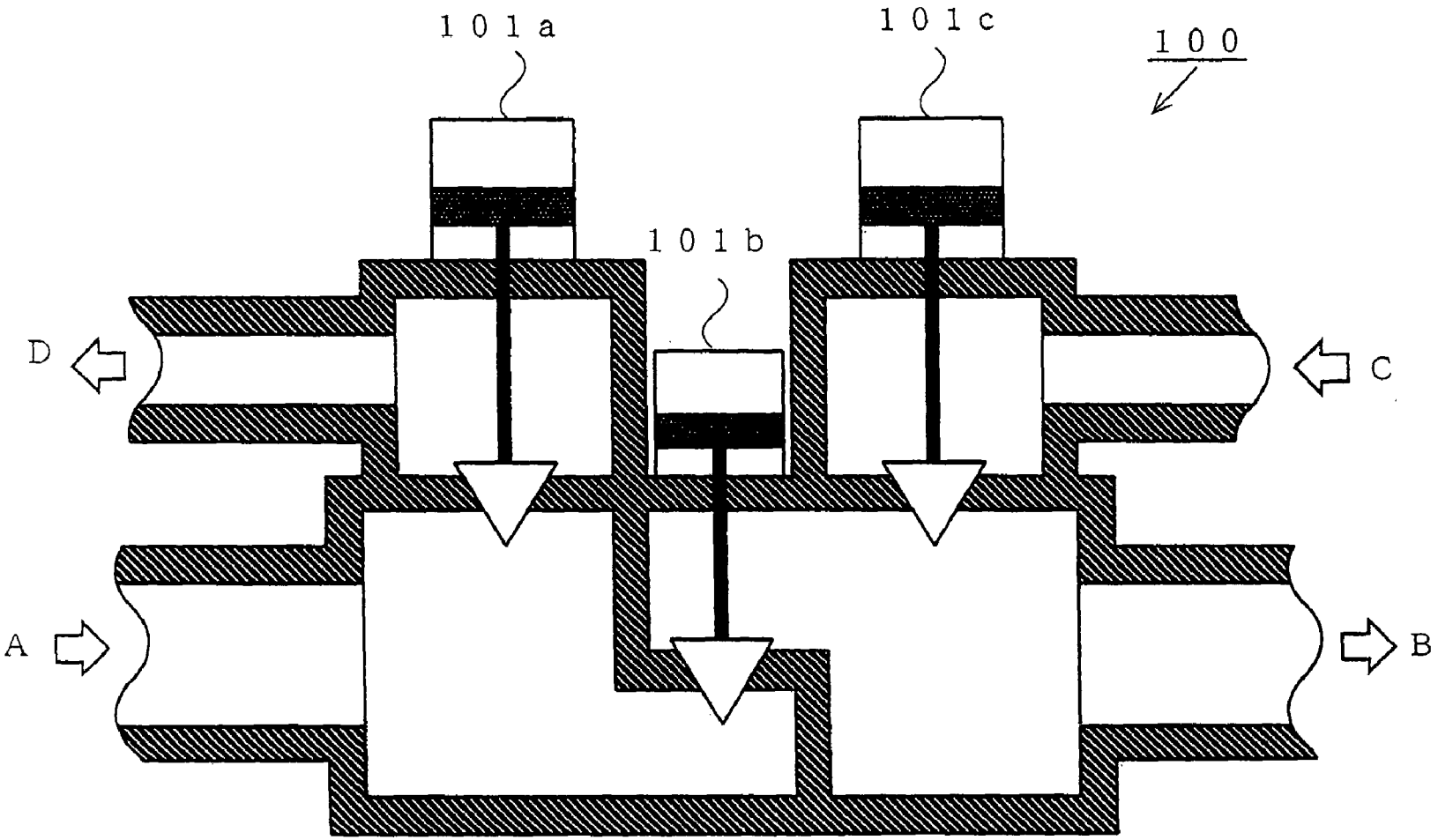
FIG. 4 is a cross-sectional view showing a bypass switching section in high pressure processing apparatuses according to second and third embodiments of the present invention.

FIG. 4 is a cross-sectional view showing the bypass switching section 100 in the present high pressure processing apparatus. The bypass switching section 100 includes four pressure-resistant conduits A, B, C, and D. The conduit A is connected to the circulation channel 11; the conduit B is connected to the heater 4; the conduit C is connected to the booster 3*a*; and the conduit D is connected to the bypass channel 12. The bypass switching section 100 includes valves 101*a*, 101*b*, and 101*c*. The valve 101*a* opens or closes communication between the conduits A and D; the valve 101*b* opens or closes communication between the conduits A and B; and the valve 101*c* opens or closes communication between the conduits B and C. The valves 101*a* to 101*c* may be opened or closed manually or by means of a control device utilizing electromagnetic force, air pressure, or the like. The bypass switching section 100 constitutes a "supply/discharge switching section" under the present invention.

Next, the operations of the respective components of the present high pressure processing apparatus will be described. While the present embodiment illustrates the case where $CO_2$ is employed as a processing fluid, any other substance which is capable of being converted into an SCF, e.g., nitrous oxide, alcohol, ethanol, or water, may be employed instead. The substrate washing technique to be used in the substrate washing chamber 5 in the present embodiment may be batch processing (i.e., a plurality of substrates are washed simultaneously) or single substrate processing.

The cylinder 1 contains liquefied $CO_2$ to be used for washing a substrate. The condenser 2 cools down and liquefies the gaseous $CO_2$ supplied from the separation/recovery bath 8. The boosters 3*a* and 3*b* may be composed of compressors or pumps, for example. The booster 3*a* compresses the $CO_2$ which has been liquefied by the condenser 2 to a predetermined pressure which is equal to or greater than a critical pressure Pc. Thus, the liquid $CO_2$ is sent to the bypass switching section 100 by way of the booster 3*a*. The channel extending from the cylinder 1 to the bypass switching section 100 constitutes a "supply line" under the present invention.

In the bypass switching section 100, only the valve 101*c* is opened, whereas the other valves 101*a* and 101*b* are closed. Accordingly, the liquid $CO_2$ is sent to the heater 4 in a subcritical or liquid state.

The heater 4 heats the liquid $CO_2$ which has been compressed by the booster 3*a* to a predetermined temperature which is equal to or greater than a critical temperature Tc. Thus, the liquid $CO_2$ is converted into an SCF, which is sent to the mixer. The super critical $CO_2$ is exemplary of a high pressure processing fluid which can be used in the present invention.

A washing component (e.g., a basic compound) is supplied from the chemical supply section 15 to the mixer 9 via the valve V7. Such a washing component may be employed in order to remove the high-molecular-weight contaminants (e.g., a resist or etching polymer) adhered on the substrate because washing components are highly effective for washing due to their ability to hydrolyze high-molecular-weight substances (which are often used as resist). Specific examples of basic compounds include one or more compound selected from the group consisting of quaternary ammonia hydroxides, quaternary ammonia fluorides, alkylamines, alkanolamines, hydroxyamines and ammonium-fluoride. Preferably, the washing components are contained in the ratio of 0.05 to 8 wt % based on the super critical $CO_2$.

Although the second embodiment illustrates a case where one type of chemical is employed, the types and number of chemicals may be arbitrarily set depending on the substrate to be processed and/or purposes of washing. The chemical is sent to the chemical mixer 9 (which constitutes a "mixing section"). The chemical mixer 9 homogeneously mixes the supplied chemical and the generated SCF at a predetermined ratio, and outputs the resultant mixture (hereinafter referred to as an "assistant-containing super critical $CO_2$") to the substrate washing chamber 5.

In the case where the washing component such as the aforementioned basic compound is not compatible with super critical $CO_2$, a compatibilizer which acts as an assistant to help the washing component to be dissolved or homogeneously dispersed in $CO_2$ is preferably employed as a chemical. Although there is no limitation as to the type of compatibilizer so long as it is capable of compatibilizing the washing component with the high pressure fluid, preferable examples of compatibilizers would include alcohols such as methanol, ethanol, or isopropanol, and alkyl sulfoxides such as dimethylsulfoxide. The compatibilizer may be selected so as to be in the range of 10 to 50 wt % based on the high pressure fluid during the washing step.

As an object to be processed, a substrate is previously placed in the substrate washing chamber 5 (which constitutes a "substrate processing section"). The substrate is washed by using the assistant-containing super critical $CO_2$ supplied in the aforementioned manner. After being used for the washing in the substrate washing chamber 5, the assistant-containing super critical $CO_2$ passes through the switching section 10 to be sent to the decompressor 7.

The assistant-containing super critical $CO_2$ which has been used for the wash process in the substrate washing chamber 5 is decompressed by the decompressor 7 for vaporization. In the separation/recovery bath 8, the $CO_2$ vaporized in the decompressor 7 is isolated from the chemical and the contaminants, and the gaseous $CO_2$ is again supplied to the condenser 2. The channel on the secondary side of the switching section 10 constitutes a "discharge line" under the present invention, and also functions as a "recovery/recycle line", because it allows the processing fluid to be recycled as the gaseous $CO_2$ is supplied again to the condenser 2.

Next, an operation of the high pressure processing apparatus in which the assistant-containing super critical $CO_2$ is circulated without flowing through the recovery/recycle line will be described. Referring to FIG. 3, the switching section 10 and the bypass switching section 100 function to isolate the wash process circulation line from the recovery/recycle line and from the supply line for the processing fluid, respectively. The bypass switching section 100 is disposed on a conduit interconnecting a secondary side of the booster 3*a* and a primary side of the heater 4. The switching section 10 is disposed on a conduit interconnecting a secondary side of the substrate washing chamber 5 and a primary side of the decompressor 7.

As described above, the switching section 10 is connected to the bypass switching section 100 by the circulation channel 11. When the high pressure processing apparatus is switched from an operation which involves a recovery step of the assistant-containing super critical $CO_2$ to a circulation process of the assistant-containing super critical $CO_2$, the booster 3*b* is activated and the switching section 10 redirects the assistant-containing super critical $CO_2$ from the substrate washing chamber 5 to the circulation channel 11, rather than to the decompressor 7.

At this time, the valve 101*b* in the bypass switching section 100 is opened, whereas the other valves 101*a* and 101*c* therein are closed. As a result, the assistant-containing super critical $CO_2$ from the circulation channel 11 is sent to the heater 4. Thus, during a circulation process of the assistant-containing super critical $CO_2$, the booster 3*b* is activated and the switching section 10 and the bypass switching section 100 are switched in the aforementioned manners, whereby the circulation line under the present invention is established. The circulation process allows the assistant-containing super critical $CO_2$ in the circulation line to be continuously used for the substrate washing, without performing a recovery step. Note that, if the chemical concentration is found stable during the circulation process, it is unnecessary to keep supplying a chemical from the chemical supply section 15.

Next, an operation of the high pressure processing apparatus in which the circulation line is cleaned will be described. Referring to FIG. 3, when the high pressure processing apparatus is switched to operate through a line for cleaning the circulation line after a circulation process, the valves 101*a* and 101*c* are opened and the valve 101*b* is closed in the bypass switching section 100. As a result, the flow from the booster 3*a* is redirected to the heater 4, whereas the flow from the circulation channel 11 is redirected to the bypass channel 12, in such a manner that the two flows do not mix together.

Thus, during a circulation line cleaning operation of the high pressure processing apparatus, the bypass switching section 100 is switched in the aforementioned manner, whereby the super critical $CO_2$ from the condenser 2 is allowed to flow all through the aforementioned circulation line (including the circulation channel 11), and thereafter is sent to the decompressor 7 via the bypass channel 12. Consequently, any chemicals, organic substances, and the like left in the circulation line are continuously sent to the separation/recovery bath 8 via the decompressor 7, together with the continuous influx of the super critical $CO_2$, and separated from the $CO_2$ gas to be discharged as effluent. After the completion of the aforementioned cleaning, all valves in the circulation line are closed to seclude the circulation line. Then, the interior of the substrate washing chamber 5 is decompressed to the atmospheric pressure, whereby the substrate processing is ended; and the substrate is retrieved from the substrate washing chamber 5. It will be appreciated that, during the placement/retrieval of the substrate, it is possible to perform an open chamber purge and establish a vent line as described in the first embodiment, by providing a vaporizer and a vent portion at appropriate positions in the high pressure processing apparatus.

Figure 5:
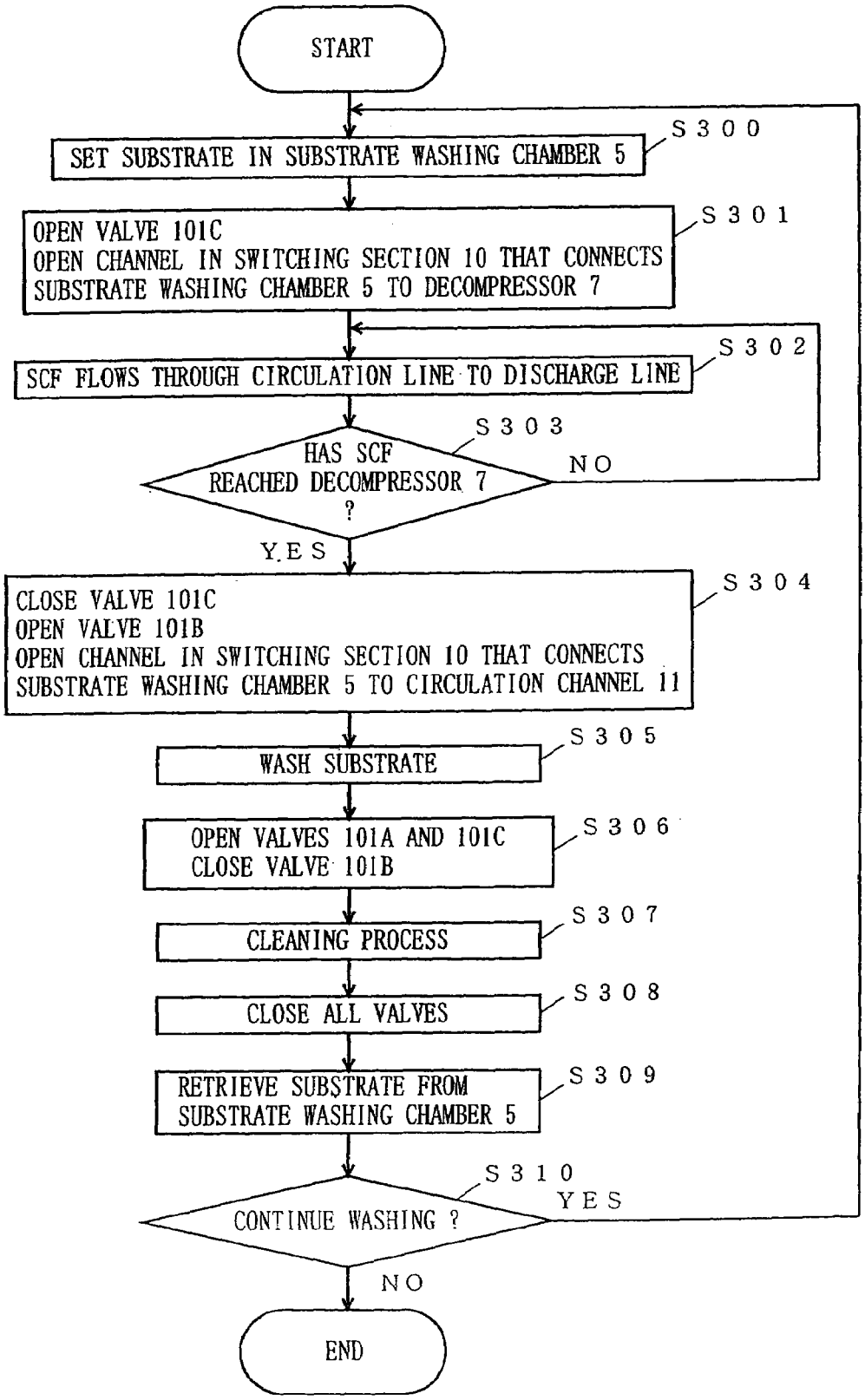
FIG. 5 is a flowchart illustrating a flow of control by a switching control section in the high pressure processing apparatus according to the second embodiment of the present invention.

The aforementioned channel switching by the switching section 10 and the bypass switching section 100 may be controlled by means of the switching control section 150. FIG. 5 is a flowchart illustrating an exemplary flow of control by the switching control section 150. Hereinafter, the control made by the switching control section 150 will be described with reference to FIG. 5.

Referring to FIG. 5, a substrate is placed in the substrate washing chamber 5 as an object to be washed (step S300). After the placement of the substrate, in order to fill the conduit line in the high pressure processing apparatus with assistant-containing super critical $CO_2$, the switching control section 150 opens the valve 101*c* in the bypass switching section 100 and opens a channel in the switching section 10 that connects the substrate washing chamber 5 to the decompressor 7 (step S301). Thereafter, the following wash process is begun.

Initially, $CO_2$ to be used as the processing fluid is stored in the cylinder 1 in a liquid form, at a pressure in the range from 5 to 6 MPa. This liquid $CO_2$ is passed to the condenser 2 so as to be stored in the liquid form. The liquid $CO_2$ is compressed by the booster 3*a* to a pressure which is equal to or greater than the critical pressure Pc, and heated by the heater 4 to a predetermined temperature which is equal to or greater than the critical temperature Tc, thereby being converted into an SCF. The SCF is sent to the chemical mixer 9 upon generation. The predetermined pressure and temperature may be arbitrarily selected based on the type of the substrate to be washed and the desired washing performance.

Under an initial state, the chemical is supplied to the chemical mixer 9 so as to achieve a predetermined level of concentration in the super critical $CO_2$. The chemical mixer 9 mixes the supplied chemical with the super critical $CO_2$, and outputs the super critical $CO_2$ containing the predetermined concentration of chemical to the substrate washing chamber 5. As the channel from the secondary side of the bypass switching section 100 to the primary side of the switching section 10 is filled with the assistant-containing super critical $CO_2$, the assistant-containing super critical $CO_2$ flows out of the switching section 10 into the decompressor 7 (step S302).

The switching control section 150 determines whether the assistant-containing super critical $CO_2$ has reached the decompressor 7 or not (step S303), and maintains the aforementioned state until it is detected that assistant-containing super critical $CO_2$has reached the decompressor 7. If it is determined at step S303 that the assistant-containing super critical $CO_2$ has reached the decompressor 7, the switching control section 150 closes the valve 101*c* and opens the valve 101*b* in the bypass switching section 100, and opens a channel in the switching section 10 that connects the substrate washing chamber 5 to the circulation channel 11 (step S304). As a result, the circulation line for circulating the assistant-containing super critical $CO_2$ is established, whereby the substrate within the substrate washing chamber 5 is washed (step S305). The substrate washing continues as the assistant-containing super critical $CO_2$ is allowed to circulate for a predetermined period of time.

After the lapse of a the predetermined washing time, the switching control section 150 opens the valves 101*a* and 101*c* and closes the valve 101*b* in the bypass switching section 100 (step S306). As a result, the interior of the circulation line is cleaned (step S307).

Next, after the lapse of a predetermined cleaning time, the switching control section 150 closes all valves in the circulation line to seclude the circulation line (step S308).

Then, the processing fluid which has been used for the substrate washing and the cleaning process is recovered for recycling. The assistant-containing super critical $CO_2$ in which contaminants are dissolved is decompressed by the decompressor 7 for vaporization, and thereafter is separated into gaseous $CO_2$, the chemical, and the contaminants in the separation/recovery bath 8. The isolated chemical and contaminants are discharged, whereas the $CO_2$ gas is recovered for recycling in the condenser 2.

Then, the interior of the substrate washing chamber 5 is decompressed to the atmospheric pressure, and the substrate is retrieved from the substrate washing chamber 5 (step S309). The process may return to step S300 to wash another substrate, or step S310 to terminate washing and end the flow.

Thus, the present high pressure processing apparatus can easily switch between the supply line for the SCF, the discharge line including the recovery/recycle line, the circulation line for realizing a circulation-based processing with an SCF, and the line for cleaning the circulation line, through the aforementioned switching of the switching section 10 and the bypass switching section 100. In the line for cleaning the circulation line, chemicals and/or any other matter left in the circulation line can be continuously discharged as effluent through the use of a single line; therefore, it is unnecessary to separately repeat a circulation step and a discharging step. As a result, the time required for the cleaning process is reduced, thereby improving the throughput of the high pressure processing apparatus. Moreover, the cost can be curtailed because the amount of SCF used for the cleaning can be reduced.

Since the present high pressure processing apparatus is capable of cleaning the line in a continuous manner, as opposed to a sporadic manner, the cleanliness within the lines can be easily improved. Furthermore, the circulation line after the cleaning process is rendered free of any chemicals which were used prior to the cleaning process. Therefore, in the case where a different chemical is to be used after the cleaning process, the unwanted mixing of the previous chemical or unwanted chemical reactions between the previous and new chemicals can be prevented. Thus, the present high pressure processing apparatus permits the use of various kinds of chemicals, without any chemical-dependent limitations on its applications.

Third Embodiment

Figure 6:
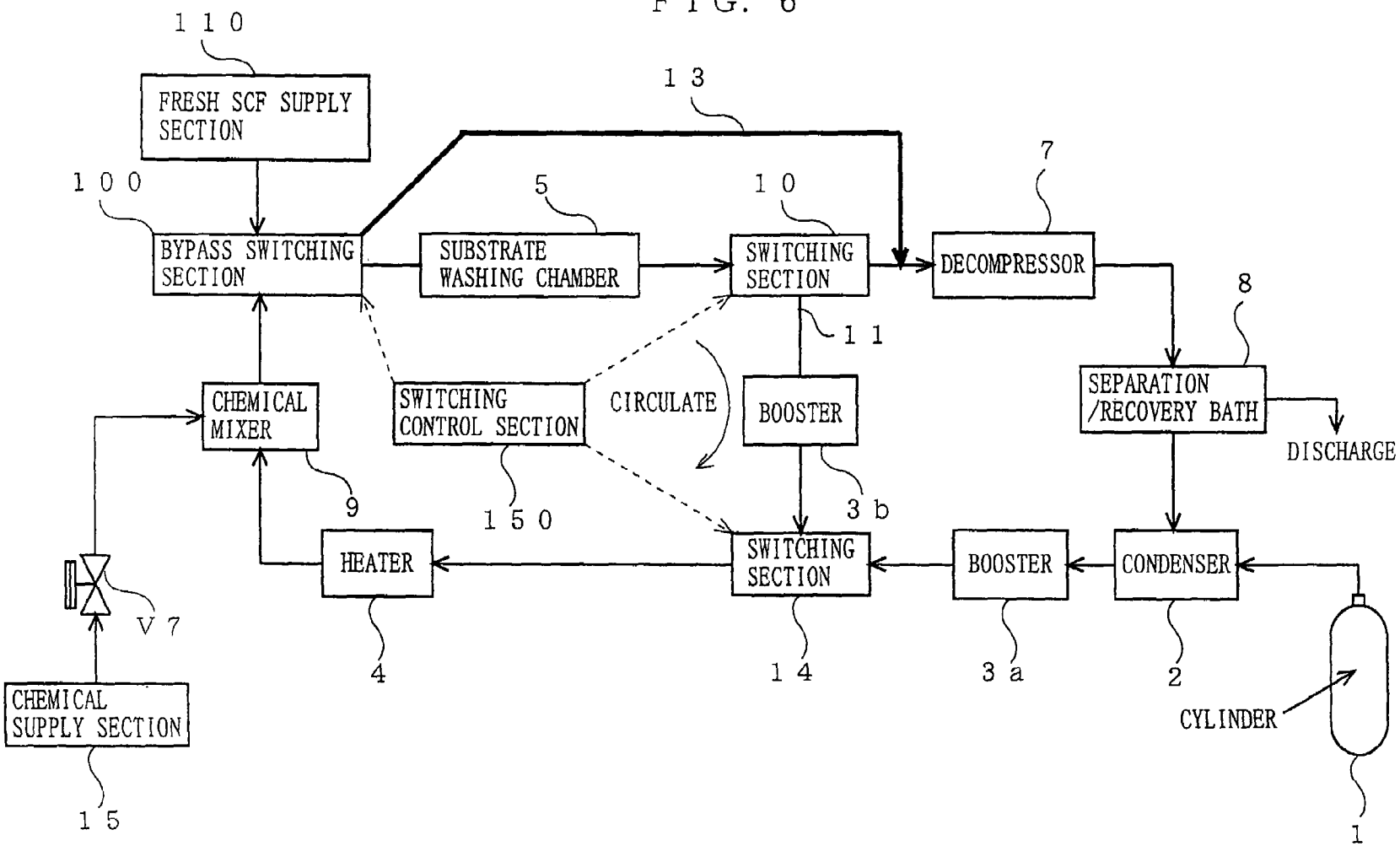
FIG. 6 is a block diagram illustrating the structure of a high pressure processing apparatus according to a third embodiment of the present invention.

FIG. 6 is a block diagram illustrating the structure of the high pressure processing apparatus according to the third embodiment of the present invention. Hereinafter, the third embodiment of the present invention will be described with reference to FIG. 6. For conciseness, any descriptions related to an open chamber purge and a closed chamber purge are omitted in the present embodiment, although an open chamber purge and a closed chamber purge (as described in the first embodiment) can be readily performed by providing a vaporizer and a vent line in the high pressure processing apparatus according to the third embodiment.

As shown in FIG. 6, the high pressure processing apparatus comprises a cylinder 1, a condenser 2, boosters 3*a* and 3*b*, a heater 4, a substrate washing chamber 5, a chemical supply section 15, a decompressor 7, a separation/recovery bath 8, a chemical mixer 9, switching sections 10 and 14, a bypass switching section 100, a fresh SCF supply section 110, and a valve V7. The connections between these components are realized by pressure-resistant conduits. A circulation channel 11 interconnects the switching sections 10 and 14. A bypass channel 13 interconnects the bypass switching section 100 and a secondary side of the switching section 10. The high pressure processing apparatus further comprises a switching control section 150 for controlling the opening and closing of the respective valves (described below) in the switching sections 10 and 14 and the bypass switching section 100.

The bypass switching section 100 in the present high pressure processing apparatus has the same structure as that employed in the second embodiment, except that the conduits A to D are connected to different locations. Specifically, in the bypass switching section 100 shown in FIG. 6, the conduit A is connected to the chemical mixer 9; the conduit B is connected to the substrate washing chamber 5; the conduit C is connected to the fresh SCF supply section 110; and the conduit D is connected to the bypass channel 13. The other component elements which are similar to those employed in the second embodiment are denoted by like numerals, and the descriptions thereof are omitted.

First, the operations of the respective components of the present high pressure processing apparatus, including the SCF recovery step, will be described. The cylinder 1 contains liquefied $CO_2$. The condenser 2 cools down and liquefies the gaseous $CO_2$ supplied from the separation/recovery bath 8. The booster 3*a* compresses the $CO_2$ which has been liquefied by the condenser 2 to a predetermined pressure which is equal to or greater than a critical pressure Pc.

The heater 4 heats the liquid $CO_2$ which has been compressed by the booster 3*a* to a predetermined temperature which is equal to or greater than a critical temperature Tc. The chemical mixer 9 homogeneously mixes the chemical supplied from the chemical supply section 15 and the super critical $CO_2$ at a predetermined ratio, and outputs the resultant mixture to the bypass switching section 100.

In the bypass switching section 100, only the valve 101*b* is opened, whereas the other valves 110*a* and 110*c* are closed. Accordingly, the assistant-containing super critical $CO_2$ is sent from the chemical mixer 9, through the bypass switching section 100, to the substrate washing chamber 5. In the substrate washing chamber 5, a substrate is washed by using assistant-containing super critical $CO_2$. After the substrate washing in the substrate washing chamber 5, the assistant-containing super critical $CO_2$ is passed through the switching section 10 to the decompressor 7.

Next, an operation of the present high pressure processing apparatus in which an SCF is circulated without undergoing a recovery step will be described. With reference to FIG. 6, when the high pressure processing apparatus is switched from an operation which involves a recovery step of the SCF to a circulation process of the SCF, the booster 3*b* is activated and the switching section 10 redirects the assistant-containing super critical $CO_2$ from the substrate washing chamber 5 to the circulation channel 11, rather than to the decompressor 7.

At this time, the switching section 14 redirects the assistant-containing super critical $CO_2$ from the circulation channel 11 to the heater 4. Thus, by activating the booster 3*b* and switching the switching sections 10 and 14 in the aforementioned manner, the circulation process allows the assistant-containing super critical $CO_2$ in the circulation line to be continuously used for the substrate washing.

Next, an operation of the high pressure processing apparatus in which the circulation line is cleaned will be described. Referring to FIG. 6, when the high pressure processing apparatus is switched to operate through a line for cleaning the circulation line after a circulation process, fresh SCF is supplied to the circulation line from the fresh SCF supply section 110. The "fresh SCF" is super critical $CO_2$ not containing any impurities such as chemicals. It is preferable that the fresh SCF is generated by a separate section for generating super critical $CO_2$, independent of the step of generating and supplying super critical $CO_2$ which is provided in the supply line.

Furthermore, the valves 101*a* and 101*c* are opened and the valve 101*b* is closed in the bypass switching section 100. As a result, the flow from the fresh SCF supply section 110 is redirected to the substrate washing chamber 5, whereas the flow from the chemical mixer 9 is redirected to the bypass channel 13, in such a manner that the two flows do not mix together.

Thus, during a circulation line cleaning operation of the high pressure processing apparatus, fresh SCF is supplied from the fresh SCF supply section 110, and the bypass switching section 100 is switched in the aforementioned manner, whereby the fresh SCF is allowed to flow all through the aforementioned circulation line (including the circulation channel 11), and thereafter is sent to the decompressor 7 via the bypass channel 13. Consequently, any chemicals, organic substances, and the like left in the circulation line are continuously sent to the separation/recovery bath 8 via the decompressor 7, together with the fresh SCF, and separated from the $CO_2$ gas to be discharged as effluent. It will be appreciated that, during the placement/retrieval of the substrate according to the third embodiment, it is possible to perform an open chamber purge and establish a vent line as described in the first embodiment, by providing a vaporizer and a vent portion at appropriate positions in the high pressure processing apparatus.

Figure 7:
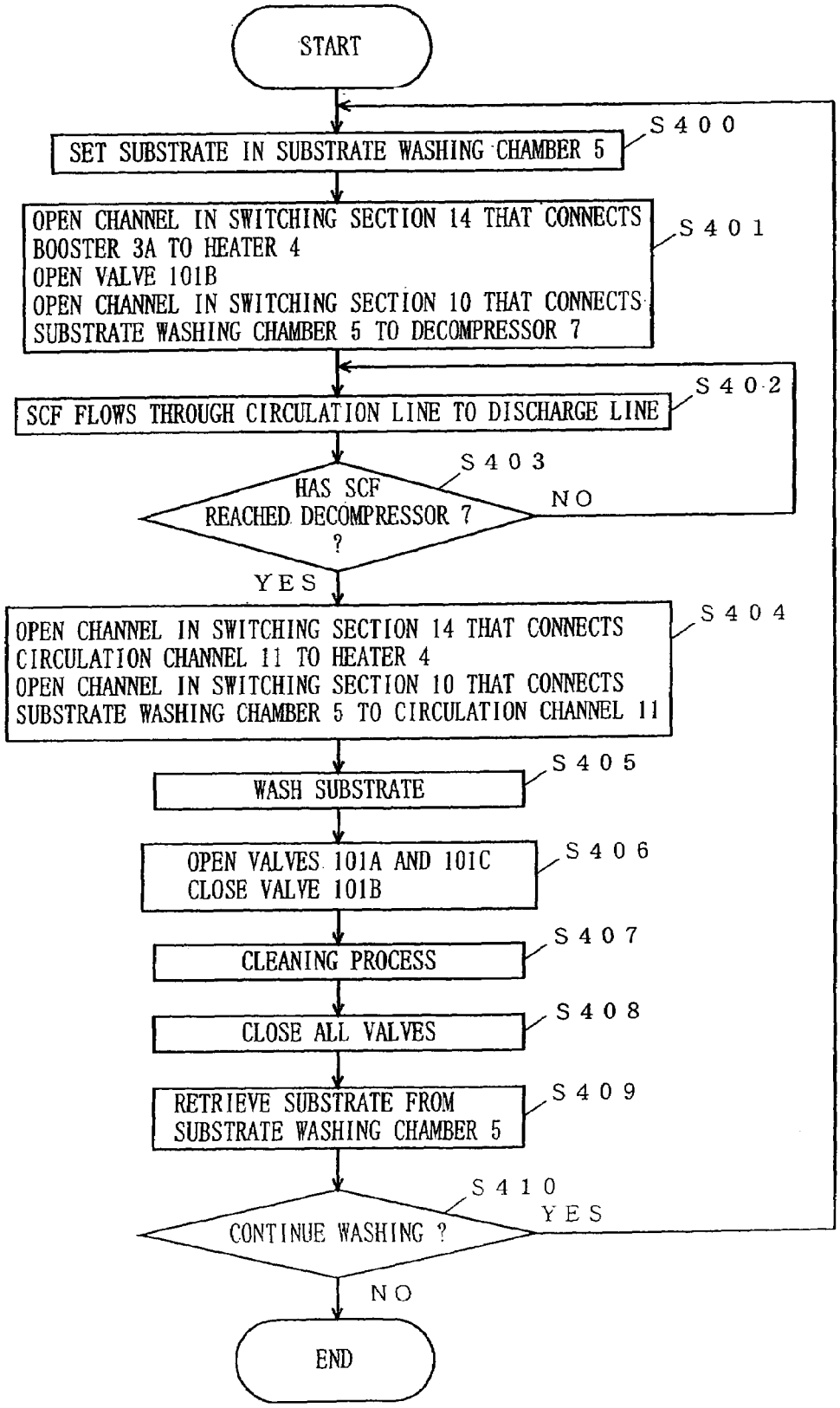
FIG. 7 is a flowchart illustrating a flow of steps of a high pressure processing method according to the third embodiment of the present invention.

The aforementioned channel switching by the switching sections 10 and 14 and the bypass switching section 100 may be controlled by means of the switching control section 150. FIG. 7 is a flowchart illustrating an exemplary flow of control by the switching control section 150. Hereinafter, the control made by the switching control section 150 will be described with reference to FIG. 7.

Referring to FIG. 7, a substrate is placed in the substrate washing chamber 5 as an object to be washed (step S400). After the placement of the substrate, in order to fill the conduit line in the high pressure processing apparatus with assistant-containing super critical $CO_2$, the switching control section 150 opens a channel in the switching section 14 that connects the booster 3*a* to the heater 4, opens the valve 101*b* in the bypass switching section 100, and opens a channel in the switching section 10 that connects the substrate washing chamber 5 to the decompressor 7 (step S401). Thereafter, the following wash process is begun.

As a result, the super critical $CO_2$ flows to the substrate washing chamber 5, out of the switching section 10, and into the decompressor 7 (step S402). The switching control section 150 determines whether the super critical $CO_2$ has reached the decompressor 7 or not (step S403), and maintains the aforementioned state until it is detected that super critical $CO_2$ has reached the decompressor 7. If it is determined at step S403 that the super critical $CO_2$ has reached the decompressor 7, the switching control section 150 opens a channel in the switching section 14 that connects the circulation channel 11 to the heater 4, and opens a channel in the switching section 10 that connects the substrate washing chamber 5 to the circulation channel 11 (step S404). As a result, the circulation line for circulating the super critical $CO_2$ is established, whereby the substrate within the substrate washing chamber 5 is washed (step S405). The substrate washing continues as the assistant-containing super critical $CO_2$ is allowed to circulate for a predetermined period of time.

After the lapse of a the predetermined washing time, the switching control section 150 opens the valves 101*a* and 101*c* and closes the valve 101*b* in the bypass switching section 100 (step S406). As a result, the interior of the circulation line is cleaned by the fresh SCF (step S407).

Next, after the lapse of a predetermined cleaning time, the switching control section 150 closes all valves in the circulation line to seclude the circulation line (step S408).

Then, the interior of the substrate washing chamber 5 is decompressed to the atmospheric pressure, and the substrate is retrieved from the substrate washing chamber 5 (step S409). The process may return to step S400 to wash another substrate, or step S410 to terminate washing and end the flow.

Thus, the present high pressure processing apparatus can easily switch between the supply line for the SCF, the discharge line including the recovery/recycle line, the circulation line for realizing a circulation-based processing with an SCF, and the line for cleaning the circulation line, through the aforementioned switching of the switching sections 10 and 14 and the bypass switching section 100. In the line for cleaning the circulation line, chemicals and/or any other matter left in the circulation line can be continuously discharged as effluent through the use of a single line; therefore, it is unnecessary to separately repeat a circulation step and a discharging step. As a result, the time required for the cleaning process is reduced, thereby improving the throughput of the high pressure processing apparatus. Moreover, the cost can be curtailed because the amount of SCF used for the cleaning can be reduced.

The present high pressure processing apparatus is capable of supplying fresh SCF directly to the substrate washing chamber 5, where residual chemicals and/or any other chemical substances generated through the processing are highly likely to be accumulated for structural reasons. Therefore, processing results with a higher cleanliness can be obtained by a wash process after the cleaning.

The present invention is not limited to the above-described second and third embodiments, but also admits of other variants, as is described below.

(1) In the second and third embodiments, the decompressor 7 provided downstream the substrate washing chamber 5 vaporizes the SCF before it is outputted to the separation/recovery bath 8. Alternatively, the SCF may be first decompressed by the separation/recovery bath 8, and thereafter separated into a gaseous component and a liquid component.

(2) In the second and third embodiments, the processing fluid is supplied to the substrate washing chamber 5 as an SCF. Specifically, the fluid supplied to the substrate washing chamber 5 is in a predetermined high-pressure state defined by a pressure equal to or greater than 1 MPa. Preferably, the fluid has a high density, a high solubility, a low viscosity, and a high diffusibility. It will be appreciated that a subcritical fluid or a high pressure gas is also applicable. Furthermore, a wash process can be performed preferably by supplying a processing fluid which is compressed to a pressure equal to or greater than 5 MPa. It is preferable to perform the wash process at a pressure in the range of 5 to 30 MPa, and more preferably in the range of 7.1 to 20 MPa.

(3) Although the high pressure processing apparatuses illustrated in the second and third embodiments are designed to perform a substrate washing, they may alternatively be employed for a substrate drying or development process. Specifically, a substrate which has undergone a rinse washing (washing with water) is placed in the substrate washing chamber 5. In the substrate washing chamber 5, the moisture adhered on the substrate can be dissolved into a high pressure processing fluid which is in a super critical or subcritical state. Thereafter, the processing fluid may be recovered for recycling, as in the above-described embodiments. In the case where the high pressure processing apparatus is employed for a substrate drying or development process, depending on the purpose of drying or the properties of the resist to be developed, xylenes, methylisobutylketone, quaternary ammonium compounds, fluorine-based polymers may be used as chemicals.

(4) The processing operation for a substrate is not limited to a single instance of a development process, a wash process, or a drying process. Rather, a number of such processes may be consecutively performed, e.g., a substrate which has undergone a development process may subsequently be subjected to a wash process. A substrate which has undergone a wash process may subsequently be subjected to a drying process.

While the invention has been described in detail, the foregoing description is in all aspects illustrative and not restrictive. It is understood that numerous other modifications and variations can be devised without departing from the scope of the invention.

What is claimed is:

1. A high pressure processing apparatus for subjecting a substrate to a predetermined process by using a high pressure fluid, comprising:

a high pressure fluid supply section for converting a predetermined processing fluid into a high pressure fluid and supplying the high pressure fluid;

a substrate processing section including a processing chamber to which a primary side conduit and a secondary side conduit are connected, for processing a substrate placed in the processing chamber by allowing the high pressure fluid to be in contact with the substrate, the high pressure fluid being supplied from the high pressure fluid supply section through the primary side conduit;

a high pressure fluid recovery section connected to the processing chamber via a first valve disposed on the secondary side conduit, for, in order to recycle the high pressure fluid, recovering the high pressure fluid via the first valve after the high pressure fluid is used for processing the substrate in the substrate processing section;

an atmosphere replacement fluid supply section for supplying an atmosphere replacement fluid into the processing chamber via the primary side conduit, the atmosphere replacement fluid being of a same composition as that of the high pressure fluid; and a discharge section comprising a conduit having a second valve disposed thereon for discharging a gas inside the processing chamber via the second valve, the conduit diverging from a part of the secondary side conduit, the part being in a position between processing chamber and the first valve, wherein during a period from when the processing chamber is closed after the placement of the substrate in the processing chamber to when the high pressure fluid begins to be supplied, in response to the supply of the atmosphere replacement fluid from the atmosphere replacement fluid supply section to the processing chamber via the primary side conduit, the gas inside the processing chamber being allowed to discharge through the secondary side conduit by the discharge section without flowing into the high pressure fluid recovery section, as a result of the first valve being closed and the second valve being opened.

2. A high pressure processing apparatus for subjecting a substrate to a predetermined process by using a high pressure fluid, comprising:

a high pressure fluid supply section for converting liquefied carbon dioxide contained in a tank into a supercritical fluid and supplying the supercritical fluid;

a substrate processing section including a processing chamber to which a primary side conduit and a secondary side conduit are connected, for processing a substrate placed in the processing chamber by allowing the supercritical fluid to be in contact with the substrate, the supercritical fluid being supplied from the high pressure fluid supply section through the primary side conduit;

a high pressure fluid recovery section connected to the processing chamber via a first valve disposed on the secondary side conduit, for, in order to recycle the supercritical fluid, recovering the supercritical fluid via the first valve after the supercritical fluid is used for processing the substrate in the substrate processing section;

an atmosphere replacement fluid supply section for supplying an atmosphere replacement fluid into the processing chamber via the primary side conduit, the atmosphere replacement fluid being of same composition as that of the supercritical fluid resulting from vaporizing the liquefied carbon dioxide contained in the tank; and a discharge section comprising a conduit having a second valve disposed thereon, for discharging a gas inside the processing chamber via the second valve, the conduit diverging from a part of the secondary side conduit and opening to the outside air, the part being at a position between the processing chamber and the first valve, wherein during a period from when the processing chamber is closed after the placement of the substrate in the processing chamber to when the supercritical fluid begins to be supplied, in response to the supply of the atmosphere replacement fluid from the atmosphere replacement fluid supply section to the processing chamber via the primary side conduit, the gas inside the processing chamber being allowed to discharge through the secondary side conduit by the discharge section without flowing into the high pressure fluid recovery section, as a result of the first valve being closed and the second valve being opened.

3. The high pressure processing apparatus according to claim 1, further comprising:

a circulation conduit which diverges from a part of the secondary side conduit, and merges with the primary side conduit, the part being in a position between the processing chamber and first valve; and a third valve disposed on the circulation conduit.

4. A high pressure processing apparatus for subjecting a substrate to a predetermined process by using a high pressure fluid, comprising:

a processing chamber for processing a substrate placed therein by allowing the high pressure fluid, which is supplied to an inside of the processing chamber, to be in contact with the substrate;

a primary side conduit connected to a primary side of the processing chamber;

a secondary side conduit connected to a secondary side of the processing chamber, the secondary side conduit diverging into at least a first secondary side conduit and a second secondary side conduit;

a high pressure fluid supply section connected to the primary side conduit, for converting a predetermined processing fluid into a high pressure fluid and supplying the high pressure fluid into the primary side conduit;

a first valve disposed on the first secondary side conduit;

a second valve disposed n the second secondary side conduit;

a high pressure fluid recovery section connected to the first secondary side conduit via the first valve, for recovering the high pressure fluid flowing out of the first secondary side conduit;

an atmosphere replacement fluid supply section connected to the primary side conduit, for supplying, into the primary side conduit, an atmosphere replacement fluid being of a same composition as that of the high pressure fluid; and a discharge section connected to the second secondary side conduit via the second valve, for discharging, to an outside of the high pressure processing apparatus, a gas flowing out of the first secondary side conduit.

5. The high pressure processing apparatus according to claim 4, wherein at least a first primary side conduit and a second primary side conduit are merged and connected to the primary side of the processing chamber, the high pressure processing apparatus further comprising:

a third valve disposed on the first primary side conduit; and a fourth valve disposed on the second primary side conduit, wherein the high pressure fluid supply section is connected to the first primary side conduit via the third valve, the atmosphere replacement fluid supply section is connected to the second primary side conduit via the fourth valve, as a result of the first and third valves being closed and the second and fourth valves being opened, a channel is formed in which the atmosphere replacement fluid supplied from the atmosphere replacement fluid supply section passes through the processing chamber and is then discharged by the discharge section to the outside of the, high pressure processing apparatus, and as a result of the second and fourth valves being closed and the first and third valves being opened, a channel is formed in which the high pressure fluid supplied from the high pressure fluid supply section passes through a processing chamber and is then recovered by the high pressure fluid recovery section.

6. The high pressure processing apparatus according to claim 4, further comprising a tank containing liquefied carbon dioxide, wherein the high pressure fluid supply section supplies, to the primary side conduit, the high pressure fluid resulting from converting the liquefied carbon dioxide contained in the tank into supercritical fluid, the atmosphere replacement fluid supply section supplies, to the primary side conduit, the atmosphere replacement fluid being of a same composition as that of the high pressure fluid resulting from vaporizing the liquefied carbon dioxide contained in the tank.

7. The high pressure processing apparatus according to claim 4, wherein the secondary side conduit includes, in addition to the first and second secondary side conduits, a circulation conduit which diverges, and then merges with the primary side conduit, the high pressure processing apparatus further comprising a fifth valve disposed on the circulation conduit.

* * * * *